US006722980B2

(12) United States Patent
Stronach

(10) Patent No.: US 6,722,980 B2
(45) **Date of Patent: *Apr. 20, 2004**

(54) WAGERING SYSTEM

(76) Inventor: Andrew M. Stronach, 14875 Bayview Avenue, Aurora, Ontario (CA), L3G 4G8

( * ) Notice: Subject to any disclaimer, the term of this patent is extended or adjusted under 35 U.S.C. 154(b) by 0 days.

This patent is subject to a terminal disclaimer.

(21) Appl. No.: 09/997,288

(22) Filed: Nov. 30, 2001

(65) Prior Publication Data

US 2002/0142816 A1 Oct. 3, 2002

Related U.S. Application Data

(63) Continuation of application No. PCT/CA00/00443, filed on May 1, 2000.
(60) Provisional application No. 60/131,806, filed on Apr. 30, 1999.

(51) Int. Cl.[7] ..... A63F 9/22
(52) U.S. Cl. ..... 463/25; 463/40; 463/42; 463/28
(58) Field of Search ..... 463/25, 28, 40, 463/42

(56) References Cited

U.S. PATENT DOCUMENTS 2,283,799 A * 5/1942 Favalora ..... 235/61 B
2,794,597 A * 6/1957 Maloof ..... 235/145 A
3,635,397 A * 1/1972 Kurland ..... 235/78 G
3,714,399 A * 1/1973 Cataland ..... 116/318
3,850,134 A * 11/1974 Colasuono ..... 116/318
3,999,041 A * 12/1976 Scofield ..... 235/61 G
4,031,376 A * 6/1977 Corkin, Jr. ..... 377/4

OTHER PUBLICATIONS

Wagner et al., Human Factors Design Guide, 1996, Department of Transportation, 8–49 through 54.*

* cited by examiner

*Primary Examiner*—Michael O'Neill
*Assistant Examiner*—Corbett B. Coburn
(74) *Attorney, Agent, or Firm*—Mark A. Litman & Associates, P.A.

(57) ABSTRACT

A wagering system comprises a race providing system facilitating wagering on race events and providing information regarding the race events, and at least one wagering terminal in communication with the race providing system. The at least one wagering terminal includes a race event selector to select next race events for wagering, a display to present information regarding the selected race events, a user interface to place a wager on an elected race event of the selected race events displayed, and a wagering value mechanism to provide a wager amount for the wager on the elected race event. Further, at least one of the race providing system and the at least one wagering terminal includes a quick pick race contestant(s) selector receiving handicapping information and odds information from the race providing system to select one or more race contestants of an elected race event for the wager in accordance with the received handicapping information and odds information.

45 Claims, 13 Drawing Sheets

WAGERING SYSTEM

This is a Continuation of International Application No. PCT/CA00/00443 filed May 1, 2000 which designated the U.S.

This application claims the benefit of PCT Application No. PCT/CA00/00443, filed May 1, 2000 and U.S. Provisional Application No. 60/131,806 filed Apr. 30, 1999.

FIELD OF THE INVENTION

The present invention relates to gaming. In particular, the present invention relates to facilitating wagering on race events.

BACKGROUND

Wagering on race events, such as horse races and dog races, typically takes the form of either fixed odds wagering or the more common parimutuel wagering. Fixed odds wagering is a system by which the return for a particular wager is determined in accordance with the payout odds assigned to the associated bet. Fixed odds wagering is popular from the perspective of wager recipients (e.g., betting parlors) since it places a limit on the magnitude of the payout in the event of a win. Fixed odds wagering is also popular from the perspective of wagerors since it provides a measure of certainty on the possible payout.

Parimutuel wagering is a system by which a wagering pool is established for the receipt of bets, and the proceeds of the pool are divided amongst holders of winning wagers in accordance with the number and types of winning wagers and the magnitude of each wager. Parimutuel wagering is popular from the perspective of the wager recipients (e.g., race track owners), since the recipient typically receives a fixed percentage of the pool prior to the payout to the winning wager holders. Also, parimutuel wagering is popular from the perspective of the wageror since the return on a particular wager is proportional to the size of the wagering pool and, therefore, can exceed the fixed odds return of the bet. However, parimutuel wagering also suffers from a number of disadvantages.

Firstly, parimutuel wagering often requires detailed knowledge of betting terminology (e.g., win, place, show, exacta, triacta, etc. wager types). Secondly, parimutuel wagering often requires the wageror to be conversant with betting forms, and to have knowledge of race contestant handicapping. For example, for horse racing, successful handicapping requires a consideration of several factors, including track conditions, horse record, and jockey record for each contestant horse. Consequently, parimutuel wagering may not provide wager recipients with a significant return since novices may be intimidated by the knowledge required and either make only minimal wagers or no wagers at all.

Therefore, attempts have been made to improve on the conventional parimutuel wagering systems to encourage wagering. For instance, AmTote International, Inc. markets video terminals which remove the need for a wageror to interact with a human wager recipient. The video terminal consists of a touch-sensitive CRT display, a card reader, and a central processing unit in communication with the CRT display, the card reader and a remote wagering computer for processing desired wagers. To place a wager, the wageror purchases a wager card, inserts the wager card into the card reader, and then selects the desired track, the desired horse (s), the wager type (e.g., win, place, show, exacta, triacta, etc.), and the amount of the wager. Although the video terminal allows the novice to conceal to a very limited extent his/her lack of familiarity with betting terminology and handicapping, it does little to encourage the novice to make wagers.

Therefore, it would be advantageous to provide a wagering system and method which encourages wagering on race events.

BRIEF DESCRIPTION OF THE DRAWINGS

Embodiments of the invention will now be described, by way of example only, with reference to the drawings, in which.

DETAILED DESCRIPTION

Figure 1:
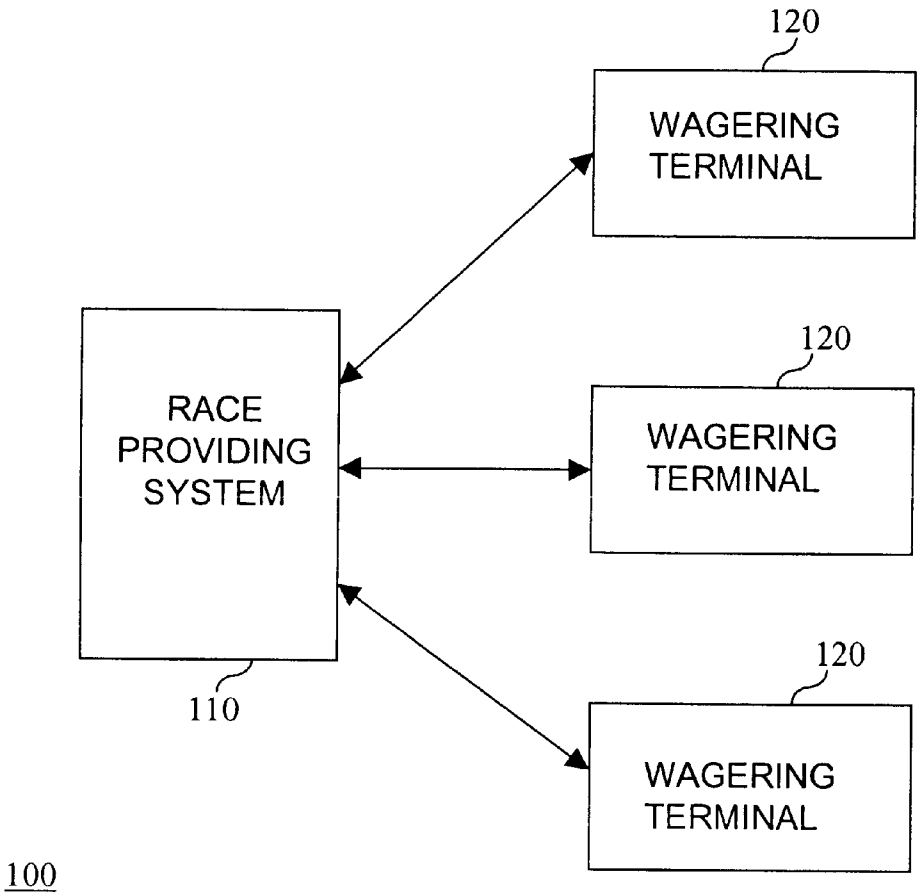
FIG. 1 is a schematic view of the wagering network, according to an embodiment of the present invention.

In an embodiment of the invention, referring to FIG. 1, a wagering network, denoted generally as 100, is shown comprising at least one wagering terminal 120 and a race providing system 110 in communication with the at least one wagering terminal. In an embodiment, the communications connection or network between the race providing system and the at least one wagering terminal comprises a closed connection or network, however the communications connection or network may instead comprise an open connection or network, such as the Internet, if the open connection or network has sufficient bandwidth for adequately servicing the at least one wagering terminal. Moreover, such a connection or network may be of any form including without limitation wire, cable or wireless.

The race providing system generally manages and processes various racing information, particularly wagering information associated with race events held at various race event tracks. An example race providing system is Amtote International, Inc.'s totalisator system which processes racing information from or related to not only race events at which Amtote provides wagering transaction services but also race events unassociated with Amtote but for which racing information is provided through the Amtote totalisator system (e.g., racing information from or related to simulcast race events). The racing information may include race event information, such as the names and start positions of the race contestants (e.g., horses, dogs) running in each race event for which the race providing system has information, the distance of each such race event, the race event track name of each such race event, the start time of each such race event, etc. The racing information may also include odds information for each race contestant, betting pool information on the betting pool associated with each race event, handicapping information, such as the weather conditions, and the jockey name, race contestant age, win record, and number of days since the last race event for each race contestant, and/or race result information such as the race results at the end of each race event. The racing information may be any combination of the race event information, odds information, betting pool information, handicapping information, race result information and/or other information as needed for the effective operation of the at least one wagering terminal. Optionally, the racing information may also include audio and video data corresponding to some or all of the race events for which the race providing system has information.

In a typical race providing system, the racing information is generated internally within the race providing system and/or obtained from associated race event tracks and, if applicable, off-track betting locations/devices and other race providing systems (not shown in FIG. 1). A race providing system may also receive racing information from an information provider, unassociated with a particular race event track, supplying racing information (e.g., information services provided by Equibase Company LLC) (not shown in FIG. 1). Further, the at least one wagering terminal provides racing information to the race providing system, particularly betting pool information. In an embodiment, the race providing system includes information related to a number of race events at one or more race event tracks so as to provide the at least one wagering terminal with information regarding a substantially continuous succession of race events. As will be apparent to those skilled in the art (but not shown in FIG. 1), each race event track or other information provider may instead of or in addition to providing their racing information to or through the intermediate race providing system, provide the racing information directly to the at least one wagering terminal over a connection or network. However, in an embodiment, a race providing system is used.

Figure 2:
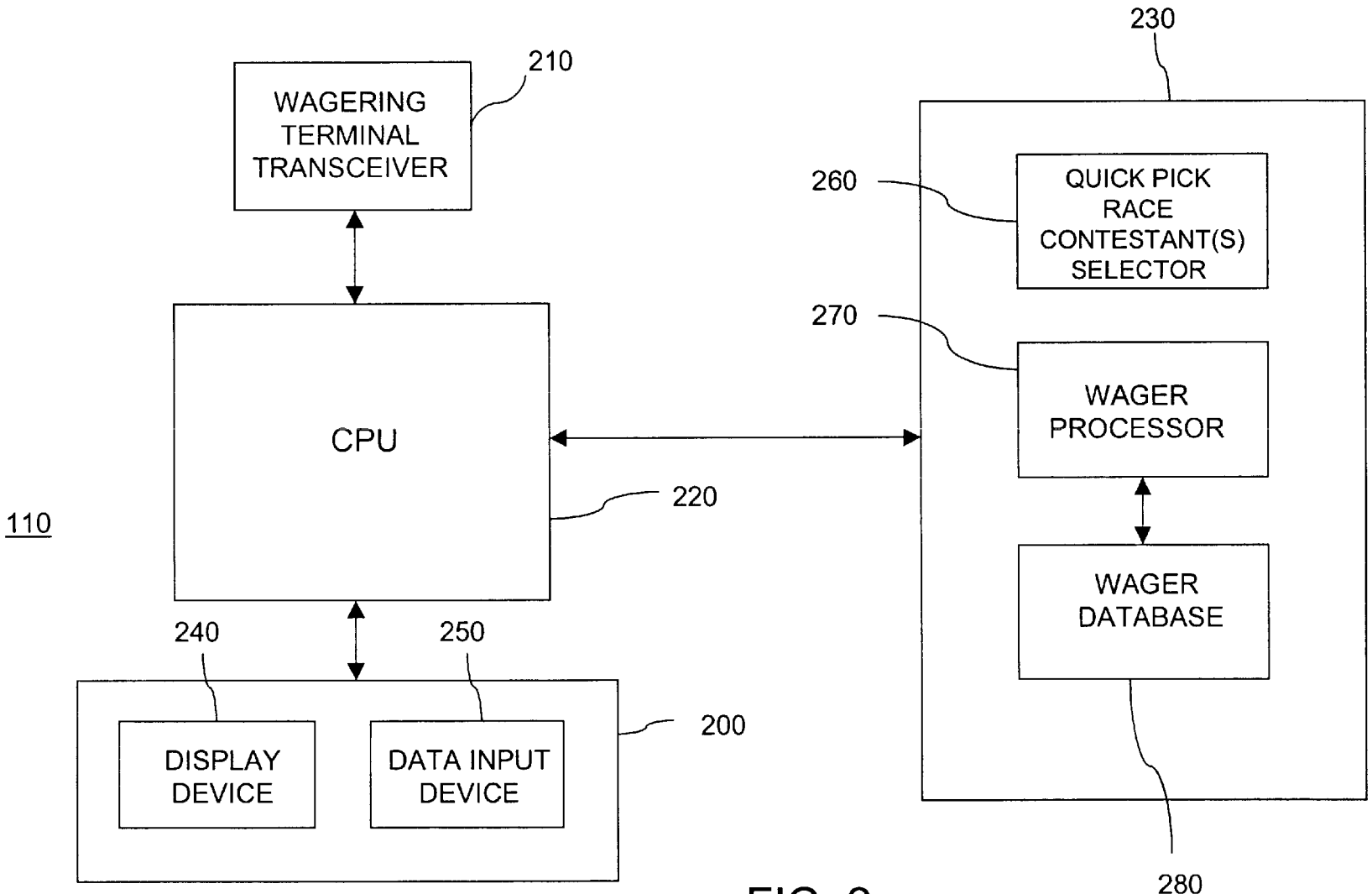
FIG. 2 is a schematic diagram of the race providing system, according to an embodiment of the present invention, shown in FIG. 1.

As shown in FIG. 2, in an embodiment, the race providing system 110 comprises a system operator interface 200, a wagering terminal transceiver 210 for communicating with the at least one wagering terminal 120, a central processing unit (CPU) 220 in communication with the system operator interface and the wagering terminal transceiver, and memory 230 in communication with the CPU.

The system operator interface comprises a data display device 240, typically comprising at least one CRT display, for allowing a system operator to view, among other things, the racing information. The system operator interface also includes a data input device 250, such as a keyboard and/or mouse, for allowing the system operator to enter control commands through the system operator interface. The control commands include commands for configuring racing information to be transmitted to the at least one wagering terminal, commands for configuring the wager processing of the race providing system, and where applicable, commands for configuring the wager type of the at least one wagering terminal.

The wagering terminal transceiver for communicating with the at least one wagering terminal is one or more mechanisms to send all or some of the racing information to the at least one wagering terminal and, where applicable, to send any other information to the at least one wagering terminal. The wagering terminal transceiver for communicating with the at least one wagering terminal is also configured to receive wagering information from the at least one wagering terminal for provision to the wagering processor. Such mechanisms may be typical communication interfaces. In an embodiment, the racing information is manipulated and formatted for sending to the at least one wagering terminal. Further, the other information sent to the at least one wagering terminal may include one or more sets of quick pick race contestant(s) and one or more least chosen race contestants for a wager type, particularly the one or more race contestants for a wager type that may yield a payout of the entire pool, both as described in more detail below.

The memory includes processor instructions for the CPU to define a quick pick race contestant(s) selector 260 and a wager processor 270. The memory also includes a wager database 280 in communication with the wager processor. As will be apparent to those skilled in the art, the memory may be non-volatile or volatile (e.g., RAM) memory or both. The wager database includes one or more wagering records that identify the network address of the at least one wagering terminal from which a wager has been placed and information regarding the wager transmitted from that at least one wagering terminal.

The wager processor is configured to receive wager information from the at least one wagering terminal (typically via the wagering terminal transceiver), to maintain the wager database with the received wager information and where applicable, to signal the appropriate at least one wagering terminal to initiate payout of winning wagers to the user of the at least one wagering terminal. Where the at least one wagering terminal is used to place parimutuel wagers, the wager processor is also configured to include the received wager information into the appropriate parimutuel pool and where applicable, obtain information on the size of the parimutuel pool for calculation of the relevant payout. Where, for example, the race providing system is connected to one or more other race providing systems, the wager processor transfers the received wager, where applicable, to the correct race providing system(s) so that the wager can be included in the appropriate parimutuel pool managed by that race providing system(s) and similarly, where applicable, obtain information on the size of the parimutuel pool from the relevant race providing system(s) for calculation of the relevant payout.

The quick pick race contestant(s) selector is used to generate one or more sets of quick pick race contestant(s) for each race event. Each set of quick pick race contestant(s) comprises one or more race contestants of a race event according to a specific wager type and is determined by a race contestant selection algorithm. The number of determined race contestants in a set of quick pick race contestant(s) primarily depends on the wager type. A set of quick pick race contestant(s) for a win, show or place wager type will comprise one race contestant. Similarly, a set of quick pick race contestant(s) for an exacta wager type will comprise two race contestants.

The race contestant selection algorithm employs handicapping information and odds information to determine a set of race contestants for a particular race event according to a specific wager type. In an embodiment pertaining to horse racing, the algorithm analyzes for each race contestant of a particular race event the handicapping information including without limitation the race contestant's trainer statistics, race contestant's jockey statistics, the track condition of the race event, and the times between race events for the race contestant. Further, the algorithm analyzes for each race contestant of a particular race event the odds information, for example the difference between the "morning line" odds and current odds information for the race contestant. The quick pick value of each race contestant may then simply be a weighted value of the handicapping information and odds information associated with each race contestant. The quick pick values for the race contestants of a race event are then analyzed to determine a set of race contestants for a specific wager type for the particular race event, preferably an optimal set of race contestants to win the specific wager type for the particular race event. As will be apparent to those skilled in the art, any number of race contestant selection algorithms are possible employing handicapping information and odds information to determine a set of race contestants for a specific wager type for a particular race event.

The quick pick race contestant(s) selector may also be implemented on the at least one wagering terminal in addition to or substitute of the quick pick race contestant(s) selector provided at the race providing system. Further, the quick pick race contestant(s) selector can determine the one or more sets of quick pick race contestant(s) automatically for each race event and/or determine the one or more sets of quick pick race contestant(s) for a race event upon request from or at the at least one wagering terminal.

In a variation, the quick pick race contestant(s) selector is configured to determine a number of sets of quick pick race contestant(s) using a number of different race contestant selection algorithms. For example, a different race contestant selection algorithm may simply be a version of a race contestant selection algorithm giving different weights to handicapping and odds information or may be a race contestant selection algorithm using different handicapping information and/or odds information to select one or more race contestant(s). The quick pick race contestant(s) selector is configured to use a different race contestant selection algorithm whenever a reselection command is received from an at least one wagering terminal in order to provide one or more new sets of quick pick race contestant(s) to that wagering terminal.

The CPU is in communication with the system operator interface, the wagering terminal transceiver and the memory. The CPU facilitates the operation of the race providing system including executing processor instructions defining the quick pick race contestant(s) selector and the wager processor. The CPU also facilitates, where applicable, the determination of one or more least chosen race contestants for a wager type, particularly the one or more race contestants for a wager type that will yield a payout of the entire pool, as described in more detail below.

Figure 3:
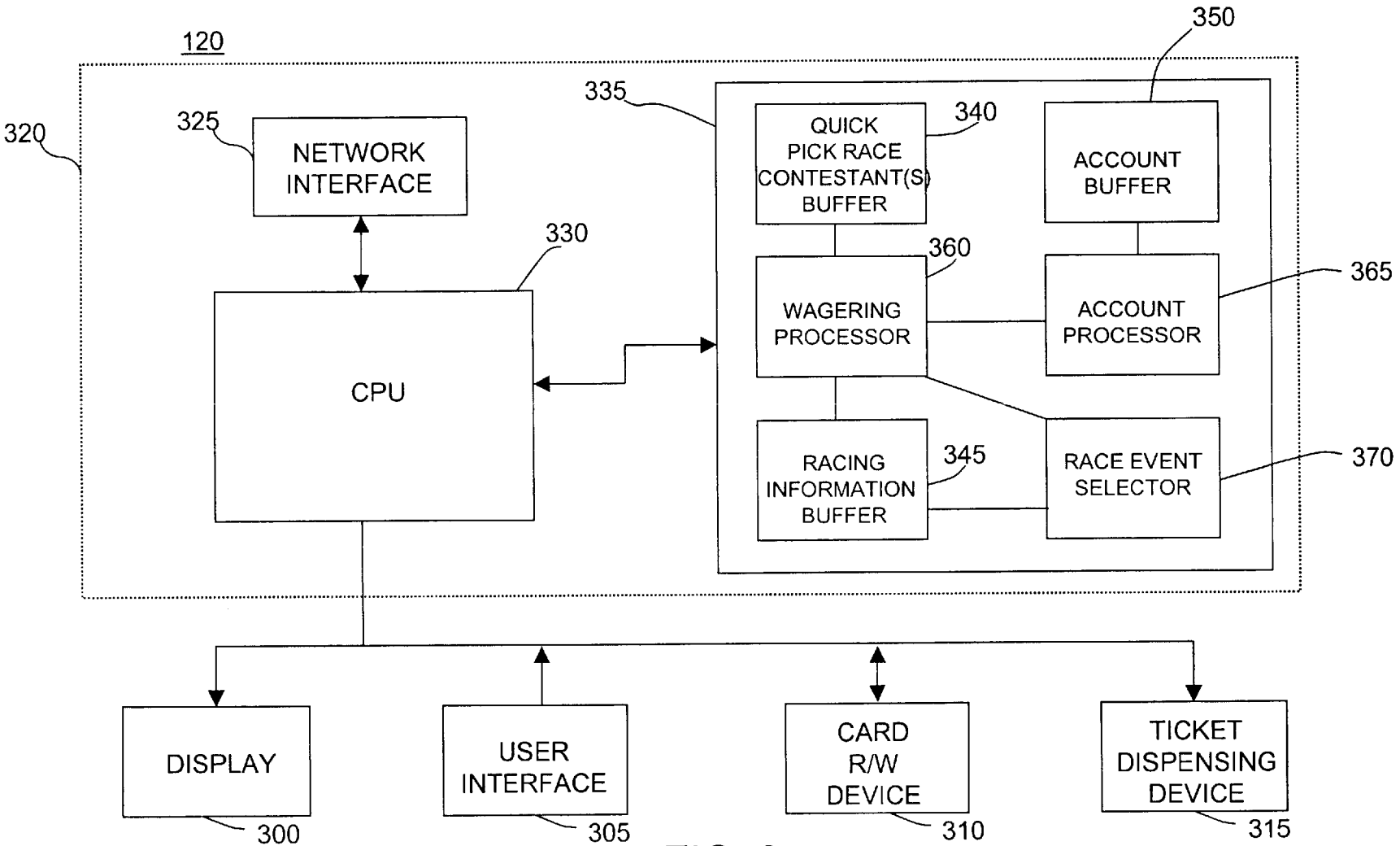
FIG. 3 is a schematic diagram of the at least one wagering terminal, according to an embodiment of the present invention, shown in FIG. 1.

Turning now to FIG. 3, a schematic diagram of an embodiment of an at least one wagering terminal 120 is shown comprising a display 300 for presenting information regarding race events received from the race providing system, a user interface 305 for placing wagers on race events, a card read/write device 310 for receiving an electronic or magnetic-stripe card encoded with a user's account information, a ticket dispensing device 315 for providing a ticket comprising wager information for an elected race event, and a processor 320 for facilitating wagering on the selected next and other future race events and for communicating with the display, the user interface, the card read/write device and the ticket dispensing device.

In an embodiment, a user opens an account specifically for wagering which is credited and/or debited as required with monetary and/or other credit values. Such an account may be set-up, for example, manually with a clerk of the establishment controlling the at least one wagering terminal or electronically by the user through telephone or the Internet. Typically, an electronic/magnetic-stripe card is issued by the establishment to the user through, for example, a clerk or automated device, and is encoded with information identifying the user's account balance. The user can then credit and/or debit monetary or other credit values through, for example, the clerk or automated device.

To place one or more wagers, the user would introduce the card to the card read/write device, a form of a wagering value mechanism, of the at least one wagering terminal on which the user would like to place one or more wagers. Thus, the card read/write device of the at least one wagering terminal allows the user to supply the monetary or other credit value needed to place a wager. Further, in an embodiment, the card read/write device of the at least one wagering terminal facilitates the payout to the user of a winning wager. As will be apparent to those skilled in the art, accounts that are not specifically set up for wagering such as bank accounts or credit accounts could be used and similarly, other types of electronic/magnetic-stripe cards such as credit cards or debit cards may be used.

Further forms of wagering value mechanisms may be provided in addition to or as a substitute for the card read/write device including a currency receiver (not shown) for receiving currency and, where applicable, a currency dispensing device (not shown) for dispensing currency payouts. The currency receiver allows the user to supply the monetary or other credit value needed to place a wager and may also be used to credit monetary or other credit value to a user's account, for example, stored on a card. The currency dispensing device may facilitate the payout to the user of a winning wager.

As will be apparent to those skilled in the art, the at least one wagering terminal may have electronic access, another form of a wagering value mechanism, to the user's account such that the user's account balance need not be on an electronic/magnetic-stripe or for that matter no card or currency device may be required. For example, the race providing system may provide facilities to access user accounts including the ability to credit and debit the user's account, to receive account information requests from the at least one wagering terminal, verify access to an account by a user using the at least one wagering terminal, etc. Alternatively, another system connected to the at least one wagering terminal may provide such access to user accounts such as credit card merchant services. The user accounts may be accounts specifically set up for wagering or may be general accounts not necessarily maintained at the race providing system such as credit or bank accounts. The at least one wagering terminal could use a card read/write device to get the necessary information for the user's account (for example, for credit and bank accounts) or could allow the user to provide the necessary information to access the user's account through the at least one wagering terminal's user interface. As will be apparent, any number of wagering value mechanisms known now or developed in the future may be employed to provide a wager amount and/or deliver a payout for a winning wager.

In an embodiment, the ticket dispensing device issues wager tickets to provide tangible evidence of a wager placed as well as to provide a means to obtain a payout of a winning wager in addition to or instead of payout via any one of the wager value mechanisms described above. The payout for a wager ticket can be obtained, for example, by providing the wager ticket to an automated machine that processes the wager ticket and provides a payout and/or credits a user's account. Alternatively, the payout can be obtained by presenting the wager ticket to a clerk who may provide the payout and/or credit a user's account. In an embodiment, the wager ticket includes, information about the wager including the race track name, race number and date of the wagered race event, the wager amount, the wager type, the selected race contestant(s) of the wager, and the user account balance. In an embodiment, the selected race contestant(s) are shown in detail for the particular wager type. For example, an exacta and 3 wheels bet would show in detail the race contestants of the 3 combinations of this wager.

The processor comprises a network interface 325 for communicating with the race providing system 110, and a central processing unit (CPU) 330 in communication with the display, the user interface, the card read/write device, and the network interface. The processor also includes a memory 335 in communication with the CPU.

The memory includes a quick pick race contestant(s) buffer 340 for receiving the quick pick race contestant(s) data for the race events received from the race providing system, a racing information buffer 345 for receiving racing information, including odds information, from the race providing system, and an account buffer 350 for recording the monetary value of finds in the user's account. The memory also includes processor instructions for the CPU to define a wagering processor 360, an account processor 365 and a race event selector 370. As will be apparent to those skilled in the art, the various buffers and processor instructions may be combined into one or provided in alternate arrangements.

The race event selector communicates with the racing information buffer and the wagering processor. The race event selector is configured to select race event information received from the race providing system for presentation on the display. In an embodiment, the race event selector is configured to determine and make available for display information about a next race event which is scheduled to run at all or certain of the race event tracks for which the race providing system has supplied race event information. The race event selector is also configured to determine and make available for display future race events in time order at all or certain of the race event tracks for which the race providing system has supplied race event information. If more than one race event is scheduled to run at or about the same time, the race event selector selects information about one of the race events for display (for example, choosing a race event at a more preferred race event track). In this manner, the at least one wagering terminal may continuously provide a succession of race events to a user upon which to wager. As will be appreciated, some race events can only entertain certain types of wagers. For instance, superfecta wagering may not be permitted at a certain race event. Consequently, the race event selector may select for display only those race events for which the at least one wagering terminal is configured to receive wagers.

Further, the race event selector is configured to accept a next or previous race selection command from the user interface via the wagering processor, thereby allowing the user to view information regarding a next race event or future race events. For example, referring to FIG. 6, the user may "scroll" back and forth through a next and other future race events by starting time by touching the "Next Race" and "Previous Race" buttons/icons, each touch of the buttons/icons causing the wagering processor to present, as applicable, updated information on the display corresponding to the "previous" or "next" race event by start time. Essentially, the user is able to view (and thus wager on) in time order a next race event and other future race events for which the at least one wagering terminal has information. In an embodiment, a next and other future race events by starting time may be the next race events by starting time found at all of the race event tracks for which the race providing system has supplied race event information. In another embodiment, a next and other future race events by starting time may be the next and other future race events at the certain current race event track which is presented on the display of the at least one wagering terminal.

The race event selector is also configured to determine and make available for display race events at different race event tracks. In this regard, the race event selector is configured to accept a next or previous race event track selection command from the user interface via the wagering processor, thereby allowing the user to view information regarding a race event at different race event tracks. For example, referring to FIG. 6, the user may "scroll" through future race events at different race event tracks by touching the "Next Track" and "Previous Track" buttons/icons, each touch of the button/icons causing the wagering processor to present, as applicable, updated information on the display corresponding to the future race events at "previous" or "next" race event tracks. Essentially, the user is able to view (and thus wager on) race events at different race event tracks for which the at least one wagering terminal has information. In an embodiment, the race event track (of all of the race event tracks for which the race providing system has supplied race event information) having the next starting race event is presented, along with that next race event, on the display of the at least one wagering terminal in response to a "next" race event track command. In another embodiment, the next race event track in alphabetical order (of all of the race event tracks for which the race providing system has supplied race event information) is presented, along with next starting race event at that race event track, on the display of the at least one wagering terminal in response to a "next" race event track command.

The account processor is in communication with the card read/write device, the account buffer and the wagering processor. The account processor is configured for crediting and debiting, in accordance with the amount wagered and the outcome of the elected race event, the balance of a user's account. For example, the account processor determines whether the user has introduced an electronic/magnetic-stripe card to the card read/write device, and then establishes an account for the user in the account buffer. The balance of the user's account may be stored, for example, on the electronic/magnetic-stripe card which is introduced to the card read/write device. Information about the amount wagered and the outcome of the elected race event is supplied by the wagering processor. The account processor performs basic checks to ensure that the user's account has a credit, that the account has enough credit for the amount wagered and that the card is otherwise operating properly.

Information regarding some or all of these checks is communicated to the wagering processor in order to allow the wagering processor to submit a wager to the race providing system. In an embodiment, the account processor is also configured to request from the user an appropriate password or other identification information via the user interface before establishing the account for the user in the account buffer. In an embodiment, the electronic/magnetic-stripe card is specially designed and configured for the at least one wagering terminal. As will be apparent to those skilled in the art, other types of cards may be used such as credit and debit cards.

The wagering processor communicates with the quick pick race contestant(s) buffer, the racing information buffer and the account processor. The wagering processor is configured to display the race contestants of the displayed race event using the odds information stored in the racing information buffer. In an embodiment, race contestants are shown as differing shaded/color icons on the display depending on the odds information associated with the race contestants. A color palette may be provided on the at least one wagering terminal to identify the colors associated with the race contestants, namely colors ranging from favorite to longshot. In an embodiment, the color palette is provided physically on the glasswork of the housing of the at least one wagering terminal although as will be apparent to those skilled in the art, the color palette may also, for example, be provided on the display or as part of a payout table (as described in more detail below with respect to FIG. 8). For example, a horse icon for a favorite horse race contestant may be shown in blue while a horse icon for a lesser favorite horse race contestant may be shown in purple (see, e.g., the color chart 1000 of FIG. 10). In an embodiment of the at least one wagering terminal, each differing shaded/color icon is associated with a rate contestant based on the win odds associated with the race contestant. If two race contestants have the same win odds, then the amount wagered on the race contestant in the win pool (if available) is used to select the favorite. Otherwise, whichever race contestant has the lower number assignment will be considered more favorite. In another embodiment of the at least one wagering terminal, each differing shaded/color icon is associated with a race contestant based on the amount wagered on the race contestant. As will be apparent to those skilled in the art, any number of means of assigning one or more colors reflecting odds associated with a race contestant may be used.

The wagering processor may also be configured to display the potential estimated winning payout of a wager on one or more race contestants of a race event according to the wager type of or selected in the at least one wagering terminal. For example, a wagering terminal configured for or in which is selected, an exacta wager type may present on a display (see, e.g., the ticker-type display of FIG. 4 and associated description below) a combination of race contestants (such as horse 5 and horse 3) of the race event about which information is shown on the display (see, e.g., the CRT display of FIG. 4 and associated description below), that may yield a certain estimated winning payout (such as $10,000 if horse 5 and horse 3 finish in that order in first and second place). In an embodiment, the greatest potential estimated winning payout(s) (and associated race contestant(s) that need to be selected to win the estimated payout(s)) is displayed according to the wager type of or selected in the at least one wagering terminal and the race event displayed on the at least one wagering terminal. In another example, a wagering terminal configured for or in which is selected, a superfecta wheeler wager type may present on a display (see, e.g., the ticker-type display of FIG. 4 and associated description below) the current pool total of the race event about which information is shown on the display (see, e.g., the CRT display of FIG. 4 and associated description below), such that perhaps a certain unique winning wager combination of the superfecta wager type may yield a payout of the pool ("jackpot").

The wagering processor is also configured to receive wager information from the user interface and for selecting one or more race contestants for the wager. For example, the wagering processor receives through the user interface an instruction for a wager amount, for an elected race event, which is transmitted to the race providing system together with the elected race contestants once the user instructs through the user interface the submission of the wager. In an embodiment, referring to FIGS. 4 and 5, the at least one wagering terminal has buttons corresponding to certain wager amounts and/or combinations which when engaged by the user instruct the wagering processor the wager amount and/or combination and a play button which when engaged by the user instructs the wagering processor to submit the wager. In an embodiment, the wagering processor employs a default wager amount and/or combination, e.g., the lowest wager amount and/or the quick pick race contestants, when it is not instructed the wager amount and/or combination through the user interface but is instructed to submit the wager.

Through the user interface, the user also can manually select the one or more race contestants for a wager or select that a set of quick pick race contestant(s) as provided in the quick pick race contestant(s) buffer is used for the wager. As discussed below, the one or more sets of quick pick race contestant(s) may be supplied in a substantially continuous fashion to the wagering processor and/or as requested by the wagering processor (typically via the quick pick race contestant(s) buffer). In an embodiment, the user can manually select one or more race contestants for a wager by touching a touch-sensitive screen of the display or may select a set of quick pick race contestant(s) by pressing the "Play" button of the at least one wagering terminal. In an embodiment, the wagering processor employs one or more race contestants from a set of quick pick race contestant(s) to complete a wager if all the necessary race contestants for the wager type have not been selected but the wagering processor is instructed nevertheless to submit the wager. In this fashion, the wager will comprise the race contestant(s) selected by the user and one or more race contestant(s) from the quick pick race contestant(s) needed to complete the wager of the applicable wager type.

The wagering processor is also configured to show on the display the race contestants that have been manually elected by the user or the race contestants in a set of quick pick race contestant(s). For example, in an embodiment, the user selection of a race contestant on a touch-sensitive display causes an icon corresponding to the race contestant to change in appearance to indicate the race contestant has been selected. Similarly, the icons of quick pick race contestant(s) may change in appearance to indicate their selection.

The wagering processor is also configured to receive information regarding the sufficiency of credit in a user's account from the account processor and to provide the amount wagered and the outcome of the elected race event to the account processor for crediting and/or debiting a user's account.

The wagering processor may also be configured to provide a prize to a user upon the submission of a wager. For example, the submission of a wager may trigger, according to a prize selection algorithm, the provision of a prize to the user, for example, in the form of a credit of the user's account or a credit or other type of prize on a ticket provided from the ticket dispensing device. In an embodiment, the prize selection algorithm may simply be a random seed or else the prize selection algorithm may determine to provide a prize after every certain amount of wager submissions through the wagering terminal. In another embodiment, where the prize selection algorithm is implemented across the wagering system, the prize selection may determine to provide a prize to a particular wagering terminal after every certain amount of wager submissions through wagering terminals throughout the wagering system.

The wagering processor may also be configured to select one or more race contestants, according the applicable wager type, which represent the least chosen one or more race contestants for the wager type, particularly the one or more race contestants for the wager type that will yield a payout of the entire pool. Such selected race contestant(s) may determined using the odds information and/or betting pool information or may be provided by the race providing system. In an embodiment, a button (titled, for example, "Jackpot" button) is provided to allow the automatic selection of such one or more race contestants for a wager.

In a variation (not shown), the user interface includes a reselect button for initiating reselection of the race contestants, and the wagering processor is configured to reinitiate selection of race contestants upon receipt of the reselection command from the user interface. In this variation, the wagering processor is configured to issue a command to the race providing system to provide a one or more new sets of quick pick race contestant(s) and then to select from the one or more new sets of quick pick race contestant(s) provided by the race providing system. In this manner, the wagering processor typically selects different quick pick race contestant(s) for each actuation of the select button.

The details of the wagering process of an embodiment, as facilitated by the processing instructions of the wagering processor, are explained in greater detail below in regards to FIG. 7.

Figure 4:
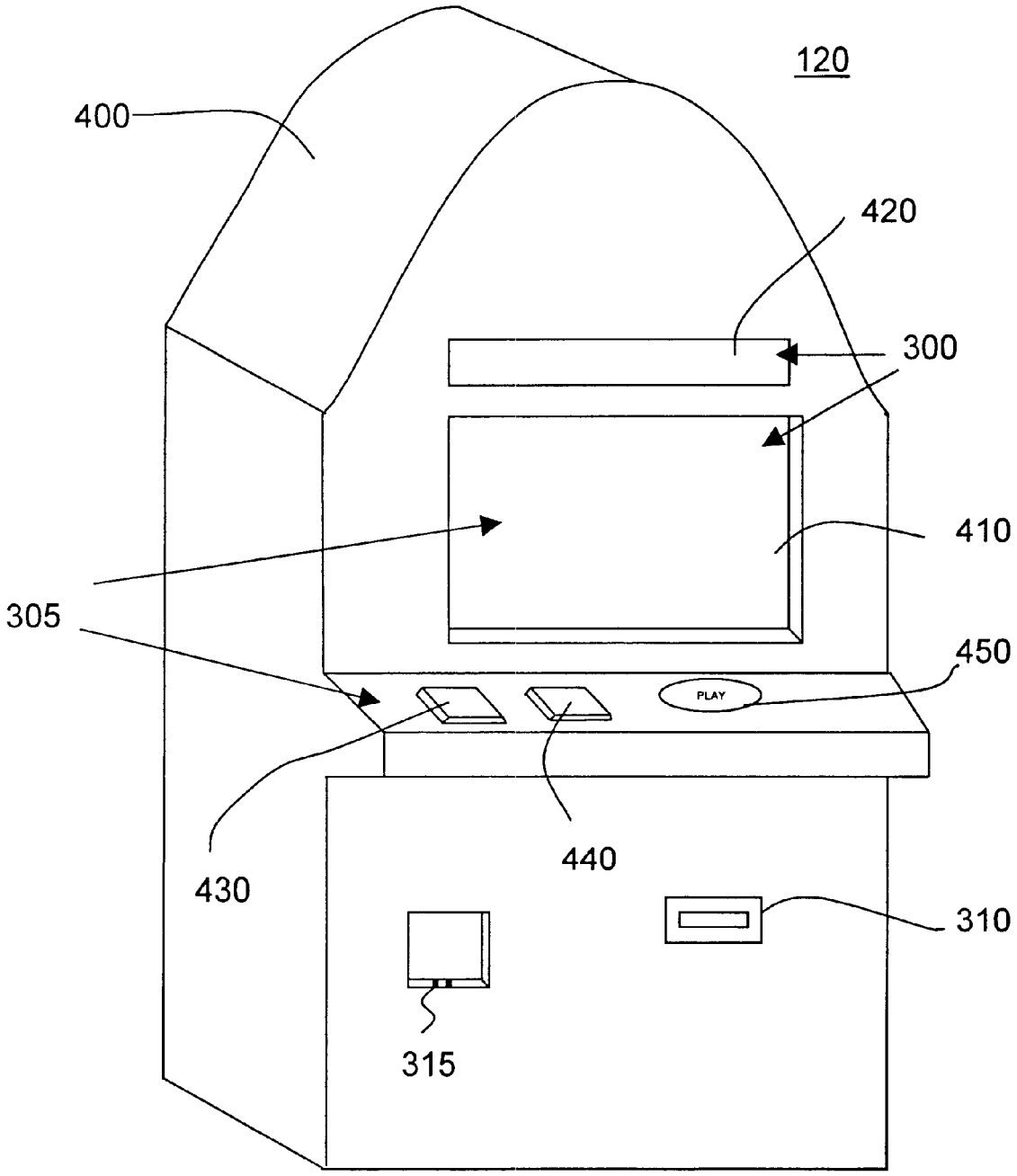
FIG. 4 is a perspective view of the stand-up type at least one wagering terminal, according to an embodiment of the present invention, shown in FIGS. 1 and 3.

Turning now to FIG. 4, an embodiment of the at least one wagering terminal 120 is shown comprising a display 300 for presenting information about the selected race events, a user interface 305 for viewing race event information and placing wagers on an elected race event, a card read/write device 310 for receiving an electronic or magnetic-stripe card encoded with a user's account information, a ticket dispensing device 315 for providing a ticket comprising wager information for an elected race event and a stand-up type housing 400 for retaining the display, the user interface, the card read/write device and the ticket dispensing device. The wagering terminal also includes a processor 320 (not shown) as discussed above for facilitating wagering on race events. The wagering terminal may also include a speaker (not shown) for playing audio associated with the wagering and race events information.

Preferably, the at least one wagering terminal according this embodiment is configured for providing a wager in only a single wager type, and the housing includes a wager description, prominently displayed on the housing, identifying the wager type using words which explain the wager type in simple betting terminology. For example, the at least one wagering terminal may be configured to provide a win, place, show, win-place-show (a win, place and show bet on a particular race contestant), exacta, triacta, superfecta, exacta and wheels, triacta and wheels and superfecta and wheels wager type. Example wager descriptions include "Pick a Winner", "Pick Two Exact Order", and "Pick Three Exact Order". In an embodiment, the wager type of the at least one wagering terminal can be changed, for example, by manually configuring the at least one wagering terminal from one wager type (e.g., exacta) to another wager type (e.g., place) or by issuing a configuration change command from the race providing system to the at least one wagering terminal to cause the at least one wagering terminal to change from one wager type (e.g., exacta) to another wager type (e.g., place). Optionally, the configuration change command can be issued to the at least one wagering terminal that in its current configuration is able to process a wager type that is not available for a next race event (about which information is made available for display and wagering on the at least one wagering terminal).

The display comprises a CRT display 410 for displaying information regarding the race events and ticker-tape type display 420 for displaying select wagering information regarding the race events. Preferably, the CRT display comprises a touch-sensitive CRT display, including a touch-sensitive membrane (not shown) in communication with the processor for "scrolling" between next and previous race events and race event tracks and for manually selecting race contestants for an elected race event. As will be apparent to those skilled in the art, any appropriate type of display may be used.

The user interface comprises a series of wager buttons 430, 440 for accepting wagers in certain wager (e.g., dollar) amounts and/or combinations. For example, referring to FIG. 4, button 430 may be engaged for a $1 wager amount and button 440 may be engaged for a $5 wager amount. Although not shown in FIG. 4, the wager buttons may also represent certain wager combinations, e.g., exacta and 2 wheels (see, e.g., buttons/icons 1010 in FIG. 10). The user interface also includes a bet submission button 450 for initiating transmission of a wager to the race providing system.

Figure 5:
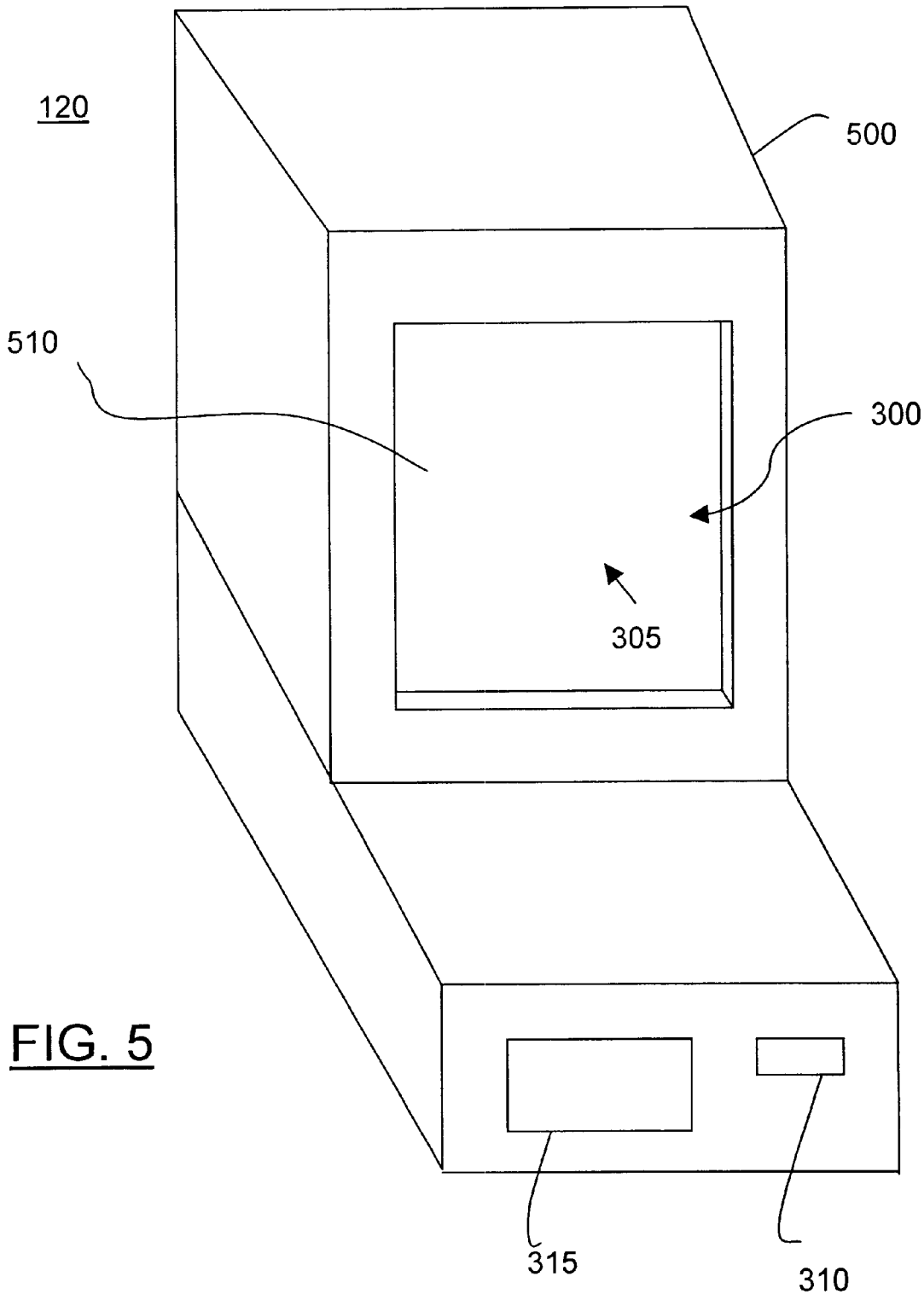
FIG. 5 is a perspective view of the tabletop type at least one wagering terminal, according to another embodiment of the present invention, shown in FIGS. 1 and 3.

Turning to FIG. 5, another embodiment of the at least one wagering terminal 120 is shown comprising a display 300 for presenting information about the selected race events, a user interface 305 for viewing race event information and placing wagers on an elected race event, a card read/write device 310 for receiving an electronic or magnetic-stripe card encoded with a user's account information, a ticket dispensing device 315 for providing a ticket comprising wager information for an elected race event and a table-top type housing 500 for retaining the display, the user interface, the card read/write device and the ticket dispensing device. The wagering terminal also includes a processor 320 (not shown) as discussed above for facilitating wagering on race events. The wagering terminal may also include a speaker (not shown) for playing audio associated with the wagering and race events information.

The display comprises a CRT display 510 for displaying information regarding the race events and preferably, the CRT display comprises a touch-sensitive CRT display, including a touch-sensitive membrane (not shown) in communication with the processor for selecting the desired wager type, for selecting the desired wager amount, for "scrolling" between next and previous race events and/or next and previous race event tracks, for manually selecting race contestants for an elected race event and for initiating transmission of a wager to the race providing system. As will be apparent to those skilled in the art, any appropriate type of display may be used.

Preferably, the at least one wagering terminal according to this embodiment is configured for providing a wager in a plurality of wager types, although as will be apparent it may be configured for a single wager type. Information presented on the display will facilitate easy selection of the wager type. For example, each time the user touches a portion of a touch-sensitive screen of the display associated with a button/icon to change the wager type of the at least one wagering terminal, the user scrolls through the various wager types offered by the at least one wagering terminal. Each time the user scrolls through the wager types offered by the at least one wagering terminal, the information regarding race events is presented according to the selected wager type. Alternatively, for example, the selection of the wager type may be performed by selecting a desired wager type in a menu presented on the display or by selection of icons corresponding to specific wager types offered by the at least one wagering terminal.

It should be understood that the configurations shown in FIGS. 4 and 5 are only an implementation for an at least one wagering terminal, and that other configurations are also envisaged. In a variation, not shown, the user interface includes a plurality of wager type buttons, each identifying a respective wager type (e.g., win, place, show, exacta, etc.), for facilitating placement of the wager according to one of a plurality of wager types.

In an embodiment of the at least one wagering terminal for a triacta wager type or the at least one wagering terminal capable of selection of a triacta wager type, a button and/or display icon may be provided for placing a $1 triacta wager amount for the three selected race contestants in the exact order as selected and another button and/or display icon may be provided for placing six $1 triacta wager amounts on the three selected race contestants in any order. Similarly, in an embodiment of the at least one wagering terminal for a superfecta wager type or the at least one wagering terminal capable of selection of a superfecta wager type, a button and/or display icon may be provided for placing a $1 superfecta wager amount for the four selected race contestants in the exact order as selected and another button and/or display icon may be provided for placing 24 $1 superfecta wager amounts on the four selected race contestants in any order.

Figure 10:
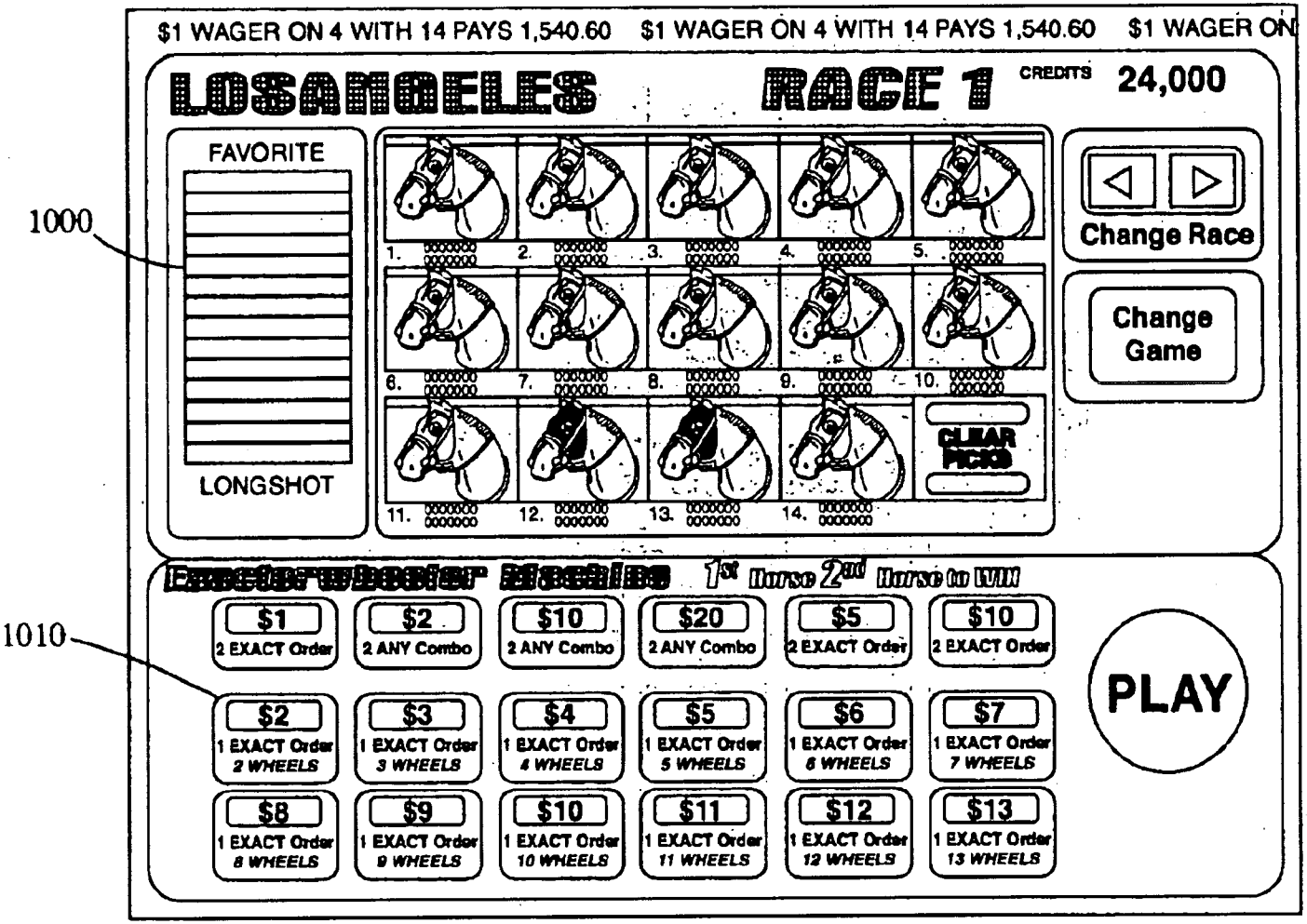
FIG. 10 is another screen shot of the information presented on a display of the tabletop type of the at least one wagering terminal according to an embodiment of the present invention. The screen provides a color chart 1000 and wagering buttons 1010.

In an embodiment of the at least one wagering terminal for an exacta and wheel wager type or the at least one wagering terminal capable of selection of an exacta and wheel wager type and referring to FIG. 10, a number of buttons and/or display icons 1010 may be provided for placing various combinations and amounts of wagers according to this wager type. For example, there may be provided a button and/or display icon for placing a $1 exacta wager amount for the two selected race contestants in the exact order as selected, a button and/or display icon for placing two $1 exacta wager amounts on the two selected race contestants in any order, a button and/or display icon for placing a $5 exacta wager amount for the two selected race contestants in the exact order as selected, a button and/or display icon for placing two $5 exacta wager amounts on the two selected race contestants in any order, a button and/or display icon for placing a $10 exacta wager amount for the two selected race contestants in the exact order as selected, and buttons and/or display icons each for placing X (where X is greater than or equal to two) number of $1 exacta and wheel wager amounts on the one selected exacta race contestant and the X selected wheel race contestants selected.

In another variation, the at least one wagering terminal may be a personal computer or a handheld device with all wagering functions provided on the display of the personal computer or handheld device for selection by use of a pointing device and/or designated keys on a keyboard associated with the personal computer or handheld device. In this variation, an electronic wager ticket mechanism may be provided in place of a physical wager ticket dispensing device. The electronic wager ticket mechanism would generate an electronic representation of the wager ticket that may be presented, for example, graphically on the display of the at least one wagering terminal. Further in this variation, a user may provide the relevant account information to the at least one wagering terminal instead of introducing an electronic or magnetic-stripe card to a card read/write device. For example, the user may manually enter the account information or employ any other electronic wallet or other automatic means for making the account information available to the wagering system. Many other variations of the wagering terminal will be apparent to those of ordinary skill in the art.

Figure 6:
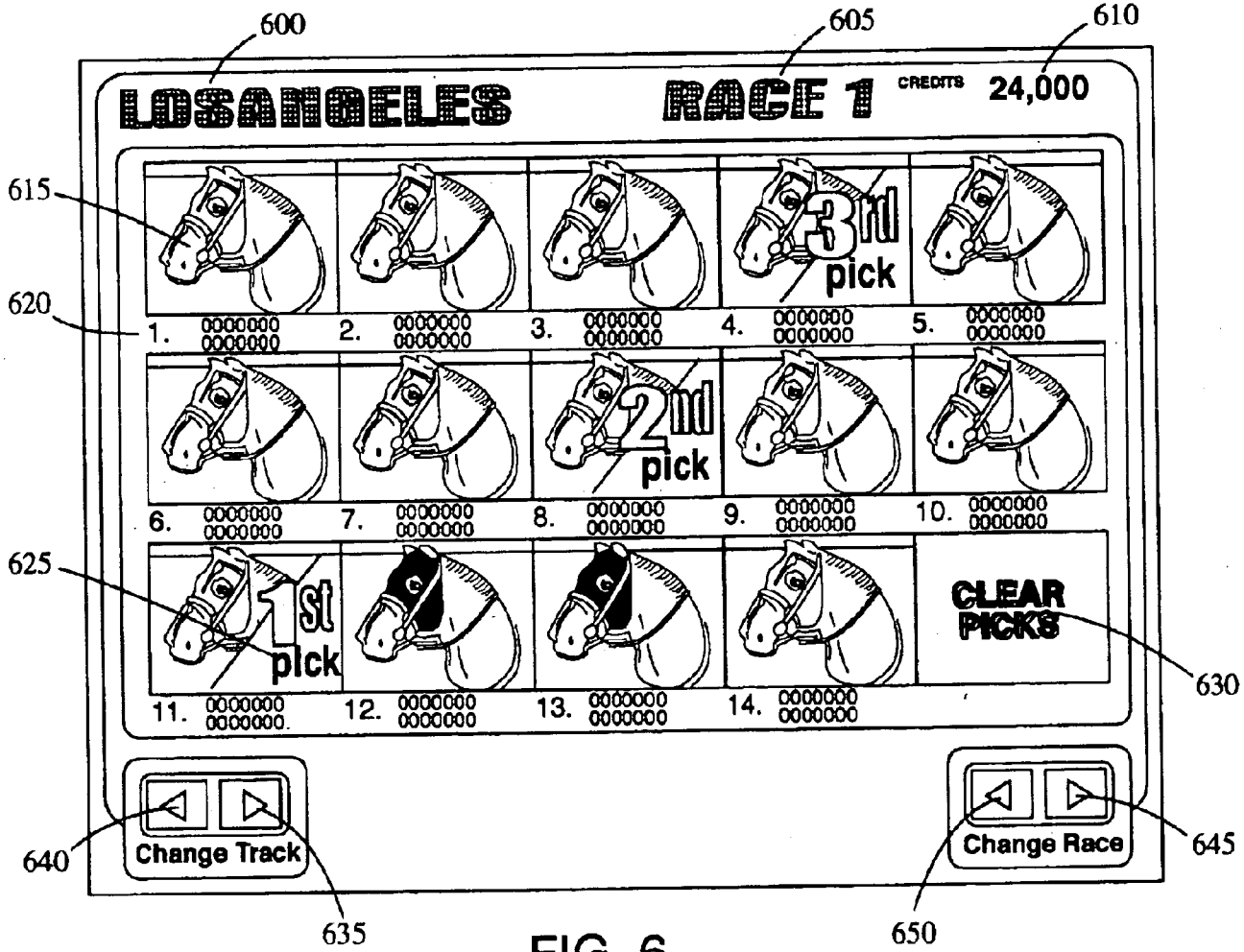
FIG. 6 is an example screenshot of the information presented on a display of the standup type at least one wagering terminal, according to an embodiment of the present invention, shown in FIGS. 1, 3 and 4.

Turning to FIG. 6, an embodiment of a screen shown on a CRT display of a stand-up type at least one wagering terminal is depicted. The screen depicts information regarding Race 1 at the Los Angeles horse race track. More particularly, race event track information 600 ("Los Angeles") and the race event number information 605 ("Race 1") are shown. The screen also depicts account balance information 610 regarding the current balance of the user of the at least one wagering terminal. In an embodiment, if the user has an insufficient account balance to wager (e.g., an account balance less than the minimum wager amount of the at least one wagering terminal), the account balance information blinks on the display to indicate an insufficient account balance. Further, the account balance information will automatically update to show credits from winning wagers of the user and, for effect, an alarm may sound for credits from winning wagers.

Further, a number of horse head shaped icons, such as horse head icon 615, associated with the race contestants of the depicted race event are shown. Moreover, the race contestant start position information, such as race contestant start position information 620 ("1"), are associated with each icon so the user can know what race contestants to select. As is indicated on the screen, the user can select one or more race contestants, in accordance with a wager type, by touching the icons. Further, in an embodiment, each horse head icon has a differently shaded/color harness. As discussed above, the different shades/colors may be used to denote differing odds information associated with each race contestant. When a user selects a race contestant on the touch-sensitive display, the icon corresponding to that race contestant changes appearance to indicate the race contestant has been selected. For example, a pick number 625 may be presented on the display to indicate the selection of the race contestant and, where applicable, the race contestant's order in selection of a set of race contestants. In an embodiment, the user can clear the selected race contestant (s) using a "Clear Picks" button/icon 630 in order to re-select one or more race contestants, as applicable, for a wager.

Further, the user may "scroll" through future race events at different race event tracks by touching the next 635 and previous 640 track buttons/icons, each touch of the buttons/icons causing the wagering processor to present, as applicable, updated information on the display corresponding to a next race event by start time at "previous" or "next" race event tracks, whether for example a race event track by alphabetical order or a race event track having the next starting race event. Similarly, the user may "scroll" through future race events by starting time, whether for example at a selected race event track or across all race event tracks, by touching the next 645 and previous 650 race buttons/icons, each touch of the icons causing the wagering processor to present, as applicable, updated information on the display corresponding to the "previous" or "next" race event by start time.

Figure 7:
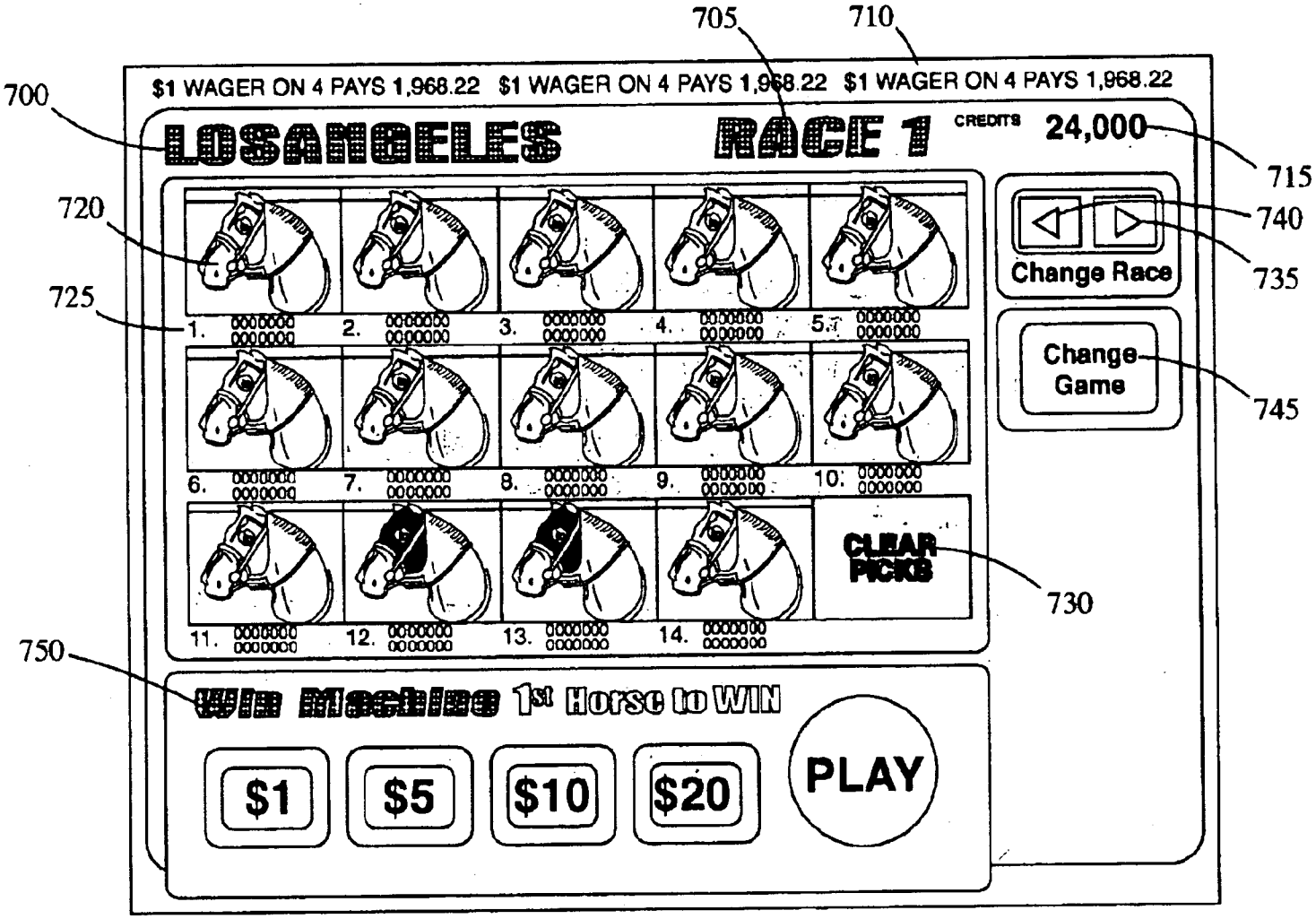
FIG. 7 is an example screenshot of the information presented on a display of the tabletop type at least one wagering terminal, according to an embodiment of the present invention, shown in FIGS. 1, 3 and 5.

Turning to FIG. 7, an embodiment of a screen shown on a CRT display of a tabletop type at least one wagering terminal is depicted. The screen depicts information regarding Race 1 at the Los Angeles horse race track. More particularly, race event track information 700 ("Los Angeles") and the race event number information 705 ("Race 1") are shown. The screen also depicts account balance information 715 regarding the current balance of the user of the at least one wagering terminal. In an embodiment, if the user has an insufficient account balance to wager (e.g., an account balance less than the minimum wager amount of the at least one wagering terminal), the account balance information blinks on the display to indicate an insufficient account balance. Further, the account balance information will automatically update to show credits from winning wagers of the user and, for effect, an alarm may sound for credits from winning wagers. Further, in an embodiment, a ticker-tape type display 710 for displaying select wagering information regarding the race events, such as potential payouts for selected race event contestants for the current wager type depicted on the screen, is provided.

Further, a number of horse head shaped icons, such as horse head icon 720, associated with the race contestants of the depicted race event are shown. Moreover, the race contestant start position information, such as race contestant start position information 725 ("1"), are associated with each icon so the user can know what race contestants to select. As is indicated on the screen, the user can select one or more race contestants, in accordance with a wager type, by touching the icons. Further, in an embodiment, each horse head icon has a differently shaded/color harness. As discussed above, the different shades/colors may be used to denote differing odds information associated with each race contestant. When a user selects a race contestant on the touch-sensitive display, the icon corresponding to that race contestant changes appearance to indicate the race contestant has been selected. For example, a pick number (not shown in FIG. 7) may be presented on the display to indicate the selection of the race contestant and, where applicable, the race contestant's order in selection of a set of race contestants. In an embodiment, the user can clear the selected race contestant(s) using a "Clear Picks" button/icon 730 in order to re-select one or more race contestants, as applicable, for a wager.

Further, the user may "scroll" through future race events at different race event tracks by touching the next and previous track buttons/icons (not shown), each touch of the buttons/icons causing the wagering processor to present, as applicable, updated information on the display corresponding to a next race event by start time at "previous" or "next" race event tracks, whether for example a race event track by alphabetical order or a race event track having the next starting race event. Similarly, the user may "scroll" through future race events by starting time, whether for example at a selected race event track or across all race event tracks, by touching the next 735 and previous 740 race buttons/icons, each touch of the icons causing the wagering processor to present, as applicable, updated information on the display corresponding to the "previous" or "next" race event by start time.

As discussed above, in the tabletop type wagering terminal, the wager type presented on the display can be changed by the user by touching the "Change Game" button/icon 745. So, by using the "Change Game" button/icon, the user may change the display to present a "Win" wager type as shown in FIG. 7 or scroll to any other wager type such as place, exacta, superfecta, etc. wager types offered by the at least one wagering terminal. For the "Win" wager type, for example, the screen comprises additional buttons/icons 750 corresponding to the win wager type of the at least one wagering terminal to allow the user to select the wager amount ("$1", "$5", "$10", "$20" buttons/icons) and to initiate the wager ("Play" button/icon). For other wager types, different additional buttons/icons may be provided as required by the particular wager type selected. As will be apparent to those skilled in the art, the wager type change feature may also be provided in the standup or any other type of display for the at least one wagering terminal.

A variation of the screen of FIG. 7 may also be used for a personal computer or handheld device variation of the at least one wagering terminal. In this variation, the screen of FIG. 7 or another screen could provide the ability for a user to enter account information (as discussed above) through, for example, the touching of a button/icon that initiates an account information entry dialog. Further, the screen of FIG. 7 or another screen could permit the user to view race event video corresponding to the race event displayed on the at least one wagering terminal. So, as the race event displayed on the at least one wagering terminal changes, the race event video would change to correspond to the displayed race event. Also, the screen of FIG. 7 or another screen could provide the display of information regarding electronic wager tickets (as discussed above) corresponding to wagers placed by the user of the at least one wagering terminal. For example, representations of unofficial electronic wager tickets corresponding to user wagers can be displayed at the bottom of the screen of FIG. 7 to show the outstanding user wagers. As the user's wagers become official, the representations of those unofficial electronic wager tickets could drop off the display at the bottom of the screen of FIG. 7. Further, a monitor bets button/icon may be provided on the screen of FIG. 7 which allows the user to review the details of all unofficial and official electronic wager tickets.

Figure 8:
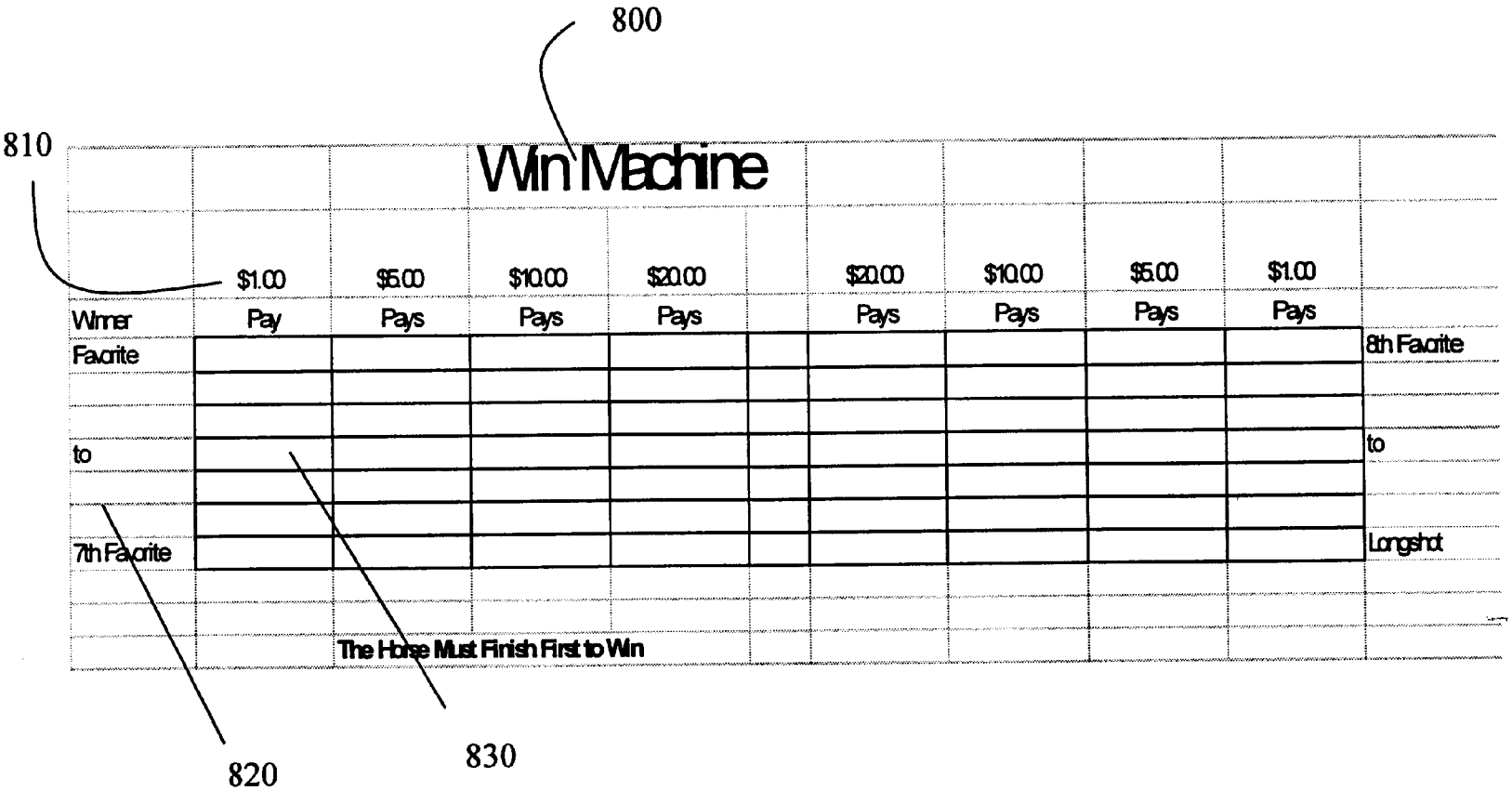
FIG. 8 is a payout table for a "Win" wager type of an at least one wagering terminal, according to an embodiment of the present invention.
Figure 9A:
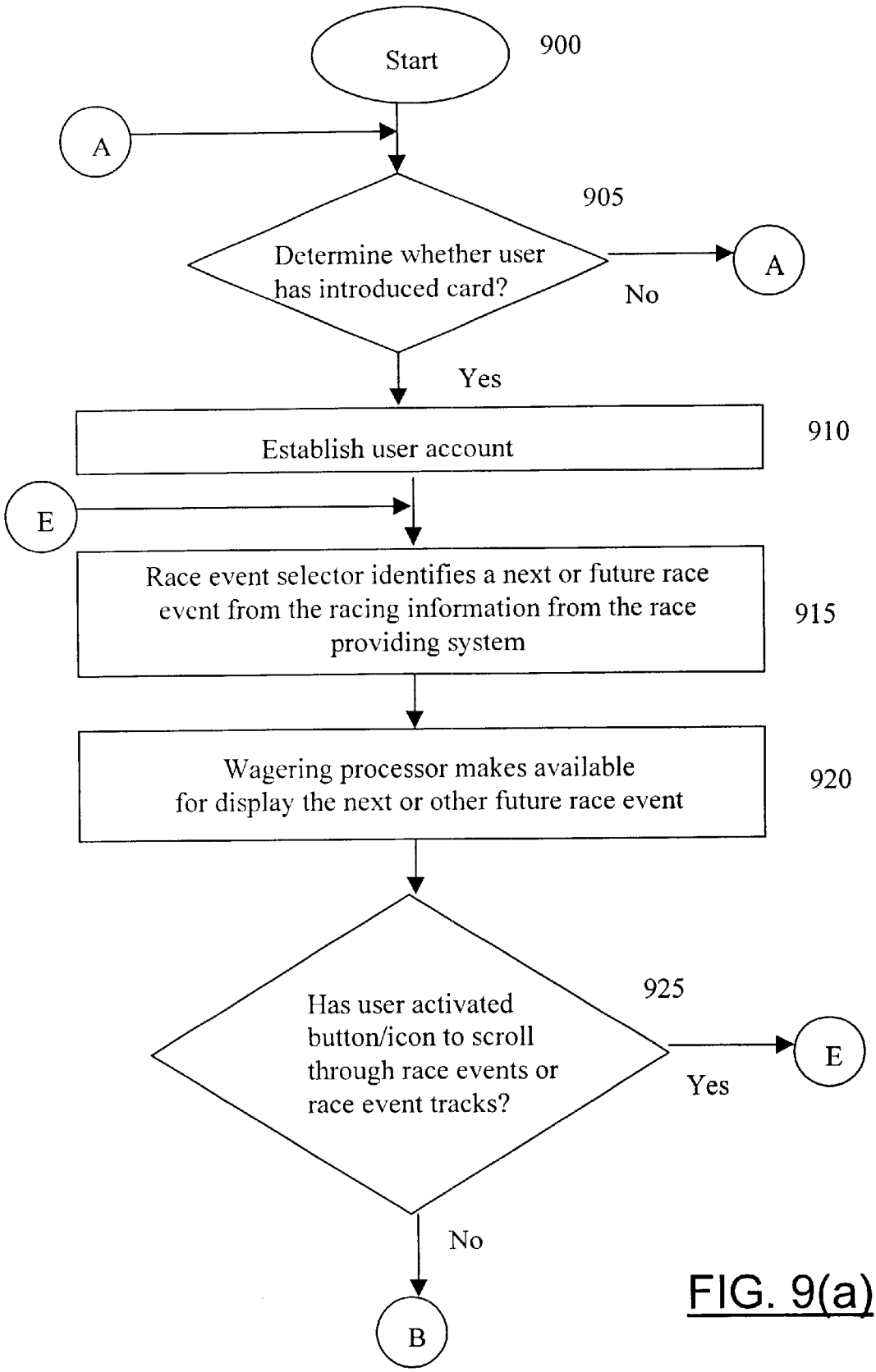
FIGS. 9(*a*), 9(*b*), 97(*c*) and 9(*d*) comprise a flow chart of the wagering facilitated by the wagering system, according to an embodiment of the present invention.
Figure 9B:
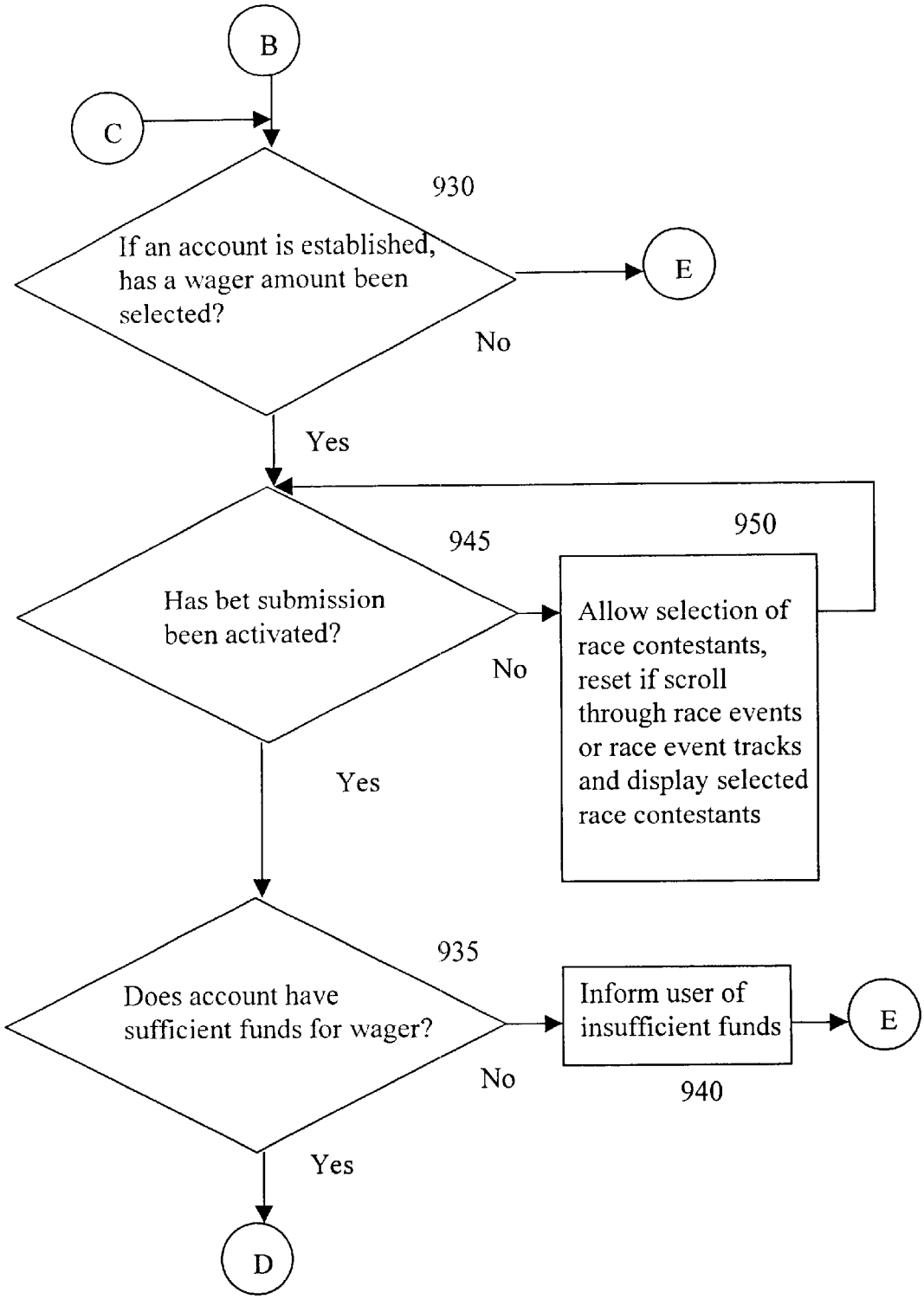
Figure 9C:
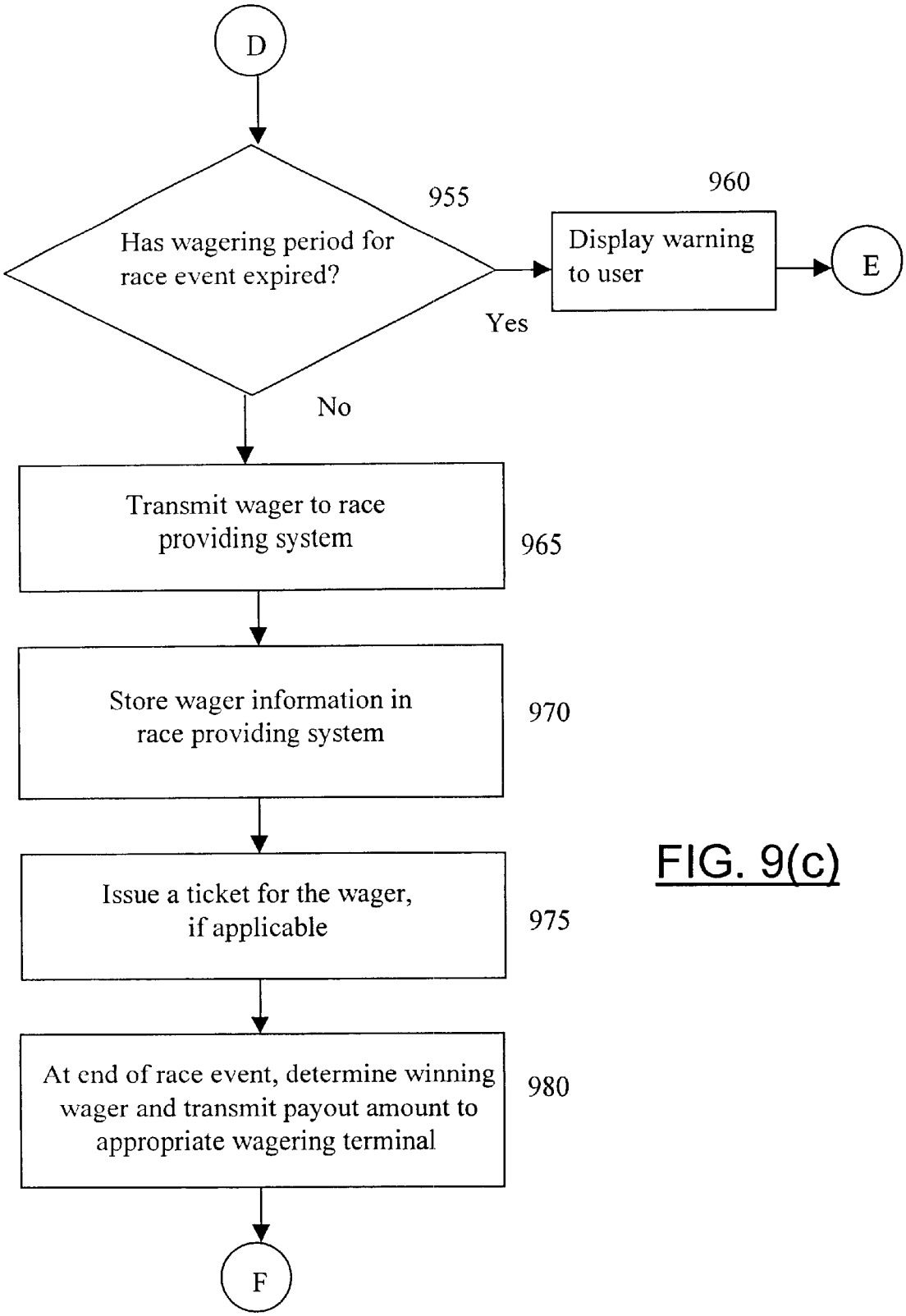
Figure 9D:
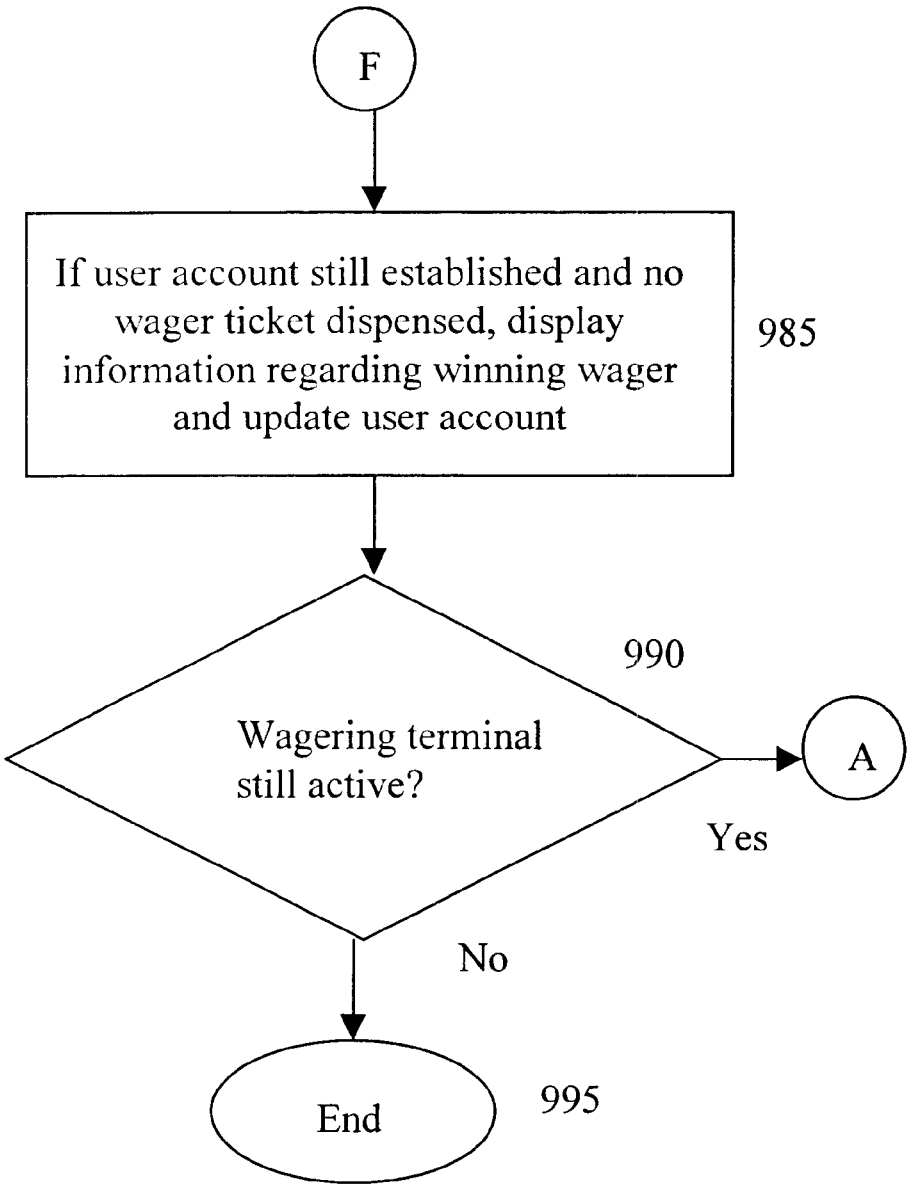

Referring to FIG. 8, a payout table is depicted for a "Win" wager type of an at least one wagering terminal. The payout table includes a title 800 generally describing the wager type, such as the win wager type in FIG. 8, of the payout information included in the table. More particularly, the payout table includes columns 810 indicating the wager amount placed for a particular wager type, e.g., $1 placed on a win wager. The payout table further includes rows 820 indicating race contestants, e.g., identifying information for each race contestant or combinations of race contestants, such as the post position or name(s) and, if applicable, the corresponding icon color (as described above), ranked from favorite to longshot. The payout table then further includes information for each row-column combination 830 indicating the actual or potential payout for the wager represented by the row and column information according to the wager type of the payout table. So, for example, the intersection in the payout table of FIG. 8 of the $1 wager amount column and the favorite race contestant would provide information for the actual or potential payout of that wager. In an embodiment, the payout table is an electronic display that provides updated payout information depending on race event and/or wager type presented on the display of the at least one wagering terminal. Alternatively, where possible, the payout table may be simply a printed table of actual or potential payout information. As will be apparent to those skilled in the art, payout tables may be provided for wager types other than the win wager type.

Referring to FIG. 9, the wagering facilitated according to an embodiment of the invention will be described. In this embodiment, the at least one wagering terminal is configured to provide a single wager type (although it may be reconfigured to a different wager type by a configuration change command). Where the at least one wagering terminal provides multiple wager types, the wagering facilitated by the wagering system according to that embodiment would query the user to select a particular wager type (not shown in FIG. 9) but would then operate according to the wagering described below in reference to FIG. 9. For example, the user interface may include a plurality of wager type buttons to allow the user to select a desired one of the wager types.

The account processor determines whether the user has introduced 905 an electronic/magnetic-stripe card to the card read/write device and if so, establishes 910 an account for the user in the account buffer if there is a credit in the account sufficient for the lowest wager amount available on the at least one wagering terminal and the card is otherwise operating properly. If the user has not introduced an electronic/magnetic-stripe card to the card read/write device, the account processor keeps determining whether a card has been introduced and the user will be unable to submit a wager or scroll through race events, e.g., the user interface is inactive, until a card is introduced. Optionally, the account processor may make available for display a warning to the user if the card is not operating properly, the user's account does not exist or there is an insufficient credit in the account. In an embodiment (not shown in FIG. 9), the account processor of the at least one wagering terminal is configured to request from the user an appropriate password or other identification information via the user interface before establishing the account for the user in the account buffer. In an embodiment (not shown in FIG. 9), a user may scroll through race events without having to introduce an electronic/magnetic-strip card to the card read/write device. In an embodiment (not shown in FIG. 9), only the buttons/icons corresponding to wager amounts and combinations available for wagering in view of the balance available in the user's account and the particular race event displayed will be active. For example, available wager amount and combination buttons/icons are lighted or shown when the user has a sufficient balance for those wager amounts and/or the wager combination is possible at the displayed race event. Similarly, the inactive wager amount and combination buttons/icons are dark or not shown when the user has an insufficient balance for those wager amounts and/or the wager combination is not possible at the displayed race event.

Once a card is introduced, the race event selector of the at least one wagering terminal queries the racing information received from the race providing system, and identifies 915 a next and other future race events, as described in more detail above, for display on the at least one wagering terminal via the wagering processor. At the outset and as the wagering pools associated with displayed race events close, the race event selector identifies a next race event for display on the at least one wagering terminal. As a user scrolls through race events by, for example, next or previous race event and/or race event track selection commands, the race event selector identifies other future race events for display on the at least one wagering terminal.

Thus, in an embodiment, a next race event is displayed on the at least one wagering terminal at the outset when a user introduces a card to the at least one wagering terminal. Thereafter, the user may scroll through race events and race events tracks but when the pool closes for a displayed race event, a further next race is displayed on the at least one wagering terminal. In essence, the race providing system provides a substantially continuous stream of racing information to the at least one wagering terminal in order to provide a substantially continuous display of information regarding a succession of race events. Further, the race providing system may also provide one or more sets of quick pick race contestant(s) as other information pertaining to the racing information in a substantially continuous fashion to the at least one wagering terminal and/or as requested by the at least one wagering terminal. Optionally, the at least one wagering terminal may receive a configuration change command to change the wager type assigned to the at least one wagering terminal.

The wagering processor makes available for display 920 the information regarding the next and other future race event, particularly the race event track name and race event number, as identified or supplied by the race event selector. Particularly, the wagering processor makes available for display, as identified or supplied by the race event selector, next race events upon the introduction of a card to the at least one wagering terminal or as the pool for a displayed race event closes and next and other future race events scrolled through by the use of next and previous race events and race event tracks selection commands.

The wagering processor further makes available for display a number of icons corresponding to the race contestants in the displayed race event, including icons of varying shade/color to identify the different odds information associated with each race contestant. The wagering processor uses, for example, the odds information in the racing information buffer to assign varying shades/colors to the icons associated with each race contestant of the displayed race event.

The wagering processor also determines 925 whether the user has activated a button/icon to scroll through race events and/or race event tracks i.e. the "Next Race", "Previous Race", "Next Track" or "Previous Track" buttons/icons. If so, the race event selector determines a next or other future race event for display and the wagering processor makes available for display information regarding the user elected next or other future race event, determined by the race event selector, resulting from the scrolling.

If an account is established, the wagering processor queries 930 whether a wager amount has been selected (for example, via selection of one of the wager buttons). If not, the at least one wagering terminal continues to determine next and/or other future race events for display, display information regarding such race events, and present on the display information regarding elected next or other future race events resulting from the scrolling through race events and/or race event tracks. In an embodiment (not shown in FIG. 9), the wagering processor employs a default wager amount, e.g., the lowest wager amount, when bet submission has been activated but no wager amount has been selected.

If a wager amount has been selected, the wagering processor waits for one or more race contestants to be selected by awaiting 935 the activation of the bet submission button i.e. the "Play" button. For example, the race contestant(s) may be manually selected 940 via touching a portion of a touch-sensitive screen of the display associated with the icon(s) of the selected race contestants (and then hits the "Play" button to submit the wager). If the user hits the "Play" button without selecting race contestants or only a partial number of the needed race contestants (not shown), the wagering processor queries the quick pick race contestant(s) buffer to derive a suitable set of quick pick race contestant(s) to complete the wager (as discussed in more detail above), in accordance with the wager type assigned to the at least one wagering terminal. If the user at any point touches a "Next Race", "Previous Race", etc. button/icon, the wagering is reset and the account processor waits for a new wager.

In a variation not shown in FIG. 9, the user interface may include a select button for initiating selection of the race contestants. Accordingly, in this variation, the user places a wager by selecting one of the wager amount buttons. The user can then manually select one or more race contestant(s) according to the wager type or activate a select button causing the wagering processor to query the quick pick race contestant(s) buffer and display a set of quick pick race contestant(s) in accordance with the wager type by, for example, changing the appearance of the icon(s) associated with those race contestant(s). If the selected race contestants are deemed by the user to be unacceptable, the user can manually select new race contestant(s) or re-activate the select button, causing the wagering processor to obtain and display a set of quick pick race contestant(s), in accordance with the wager type, picked using an alternate algorithm for selecting quick pick race contestant(s). Once the race contestants are deemed by the user to be acceptable, the user completes the wager by activating the bet submission button i.e. touching the "Play" button. As will be apparent, error checking loops may be employed with related dialogues for display to the user.

If the selected race contestant(s) were picked manually by the user, the wagering processor then presents 950 the manually selected race contestant(s) on the display by, for example, changing the appearance of the icon(s) associated with those race contestant(s) (for example, as described above in more detail). If the selected race contestant(s) are deemed by the user to be unacceptable, the user can override the selection by, for example, touching a button or a portion of a touch-sensitive screen of the display associated with an icon for resetting the manually selected race contestant(s) so a new set of selected race contestant(s) can be manually chosen or a set of quick pick race contestant(s) can be chosen by pressing the "Play" button. Alternatively, the user can continue to pick race contestants until too many race contestants have been chosen at which point the selection of race contestants is reset so a new set of selected race contestant(s) can be manually chosen or a set of quick pick race contestant(s) can be chosen by pressing the "Play" button. If the user at any point touches a "Next Race", "Previous Race", etc. button/icon the wagering is reset 950 and the account processor waits for a new wager. If the manually selected race contestant(s) are deemed by the user to be acceptable, the user completes the wager by activation of the bet submission button i.e. the "Play" button. As will be apparent, error checking loops may be employed with related dialogues for display to the user.

Once the bet submission has been activated, the account processor queries 945 the account buffer to determine whether there are sufficient funds in the user's account for the wager. If the account processor determines that the account does not have sufficient funds for the wager, the wagering processor is informed 950 of the insufficient funds and the wagering processor presents a message on the display indicating that the user has an insufficient credit balance for the wager. The account processor then checks for next race events, as applicable, and waits for a new wager. In an embodiment, the screen of the display of the at least one wagering terminal shows a spinning reel animation with sound effects until the wager ticket is printed or displayed. When the animation is finished, the screen optionally will pause to show the race contestant(s) selected for the wager centered on the middle of the screen. After the pause, the screen will revert back to where another wager may be placed.

If the account processor determines that the account does have sufficient funds for the wager, the wagering processor then determines 955 whether the wagering period has expired for the race event upon which the wager has been placed, that is, if the race event has started or the ability to wager on the race event has been closed. If the wagering processor determines that the wagering period has expired, the at least one wagering terminal will present 960 on the display a warning to the user to indicate that the wagering period has expired, continues to determine next and future race events for display, displays information regarding such race events, etc. As will be apparent, since the race providing system continuously updates the at least one wagering terminal with information on the future race events, shortly after a wagering period expires the at least one wagering terminal will display information about a next race event.

If the wagering processor determines that the wagering period has not expired, the wagering processor transmits 965 the wager amount and the selected race contestant(s) to the race providing system. The race providing system stores 970 the wager information in the wager database, together with the network address of the at least one wagering terminal. The race providing system continues to receive wagers until the end of the wagering period of a race event. The wagering terminal may also issue 975 a ticket corresponding to the wager, which can be used to obtain a payout for a winning wager via an automatic device and/or a clerk. The delivery of a ticket may be initiated by the activation of the bet submission button i.e. the "Play" button and/or by a separate button/icon activated by the user to request the printing of a ticket.

In an embodiment, at the end of a race event, the wager processor of the race providing system queries 980 the wager database to identify the winning wagers, calculates the payout payable to each user in accordance with the amount wagered (and either the payout odds if the wager was a fixed odds wager, or the size of the parimutuel pool if the wager was a parimutuel wager), and then transmits to each winning wagering terminal (using the network address stored in the wager database) a data packet indicating the payout amount.

Upon receipt of the winning contestant data packet, if the user's account is still established in the at least one wagering terminal and a ticket with respect to the winning wager has not been dispensed, the at least one wagering terminal presents 985 on the display information regarding a winning payout. Upon receipt of the payout data packet and if the user's account is still established in the at least one wagering terminal, the account processor updates the user's account including, if appropriate, updating the account information on an electronic/magnetic-stripe card. The user can then place a wager on the next race event, or else discontinue wagering by closing the user's account on the at least one wagering terminal by, for example, disengaging the electronic/magnetic-stripe card from the card read/write device. If the wagering terminal is still active 990, the wagering terminal will determine whether a user has introduced a card, identify future race events, etc.

The detailed descriptions may have been presented in terms of program procedures executed on a computer or network of computers. These procedural descriptions and representations are the means used by those skilled in the art to most effectively convey the substance of their work to others skilled in the art. The embodiments of the invention may be implemented as apparent to those skilled in the art in hardware or software, or any combination thereof. The actual software code or hardware used to implement the invention is not limiting of the invention. Thus, the operation and behavior of the embodiments often will be described without specific reference to the actual software code or hardware components. The absence of such specific references is feasible because it is clearly understood that artisans of ordinary skill would be able to design software and hardware to implement the embodiments of the invention based on the description herein with only a reasonable effort and without undue experimentation.

A procedure is here, and generally, conceived to be a self-consistent sequence of operations leading to a desired result. These operations comprise physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bits, values, elements, symbols, characters, terms, numbers, objects, attributes or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations of the invention described herein; the operations are machine operations. Useful machines for performing the operations of the invention include general purpose digital computers, special purpose computers or similar devices.

Each operation of the method may be executed on any general computer, such as a mainframe computer, personal computer or the like and pursuant to one or more, or a part of one or more, program modules or objects generated from any programming language, such as C++, Java, Fortran, etc. And still further, each operation, or a file, module, object or the like implementing each operation, may be executed by special purpose hardware or a circuit module designed for that purpose. For example, the invention may be implemented as a firmware program loaded into non-volatile storage or a software program loaded from or into a data storage medium as machine-readable code, such code being instructions executable by an array of logic elements such as a processor or other digital signal processing unit. Any data handled in such processing or created as a result of such processing can be stored in any memory as is conventional in the art. By way of example, such data may be stored in a temporary memory, such as in the RAM of a given computer system or subsystem. In addition, or in the alternative, such data may be stored in longer-term storage devices, for example, magnetic disks, rewritable optical disks, and so on.

In the case of diagrams depicted herein, they are provided by way of example. There may be variations to these diagrams or the operations described herein without departing from the spirit of the invention. For instance, in certain cases, the operations may be performed in differing order, or operations may be added, deleted or modified.

An embodiment of the invention may be implemented as an article of manufacture comprising a computer usable medium having computer readable program code means therein for executing the method operations of the invention, a program storage device readable by a machine, tangibly embodying a program of instructions executable by a machine to perform the method operations of the invention, or a computer program product. Such an article of manufacture, program storage device or computer program product may include, but is not limited to, CD-ROM, CD-R, CD-RW, diskettes, tapes, hard drives, computer system memory (e.g. RAM or ROM), and/or the electronic, magnetic, optical, biological or other similar embodiment of the program (including, but not limited to, a carrier wave modulated, or otherwise manipulated, to convey instructions that can be read, demodulated/decoded and executed by a computer). Indeed, the article of manufacture, program storage device or computer program product may include any solid or fluid transmission medium, whether magnetic, biological, optical, or the like, for storing or transmitting signals readable by a machine for controlling the operation of a general or special purpose computer according to the method of the invention and/or to structure its components in accordance with a system of the invention.

An embodiment of the invention may also be implemented in a system. A system may comprise a computer that includes a processor and a memory device and optionally, a storage device, an output device such as a video display and/or an input device such as a keyboard or computer mouse. Moreover, a system may comprise an interconnected network of computers. Computers may equally be in stand-alone form (such as the traditional desktop personal computer) or integrated into another apparatus (such as a cellular telephone).

The system may be specially constructed for the required purposes to perform, for example, the method of the invention or it may comprise one or more general purpose computers as selectively activated or reconfigured by a computer program in accordance with the teachings herein stored in the computer(s). The system could also be implemented in whole or in part as a hard-wired circuit or as a circuit configuration fabricated into an application-specific integrated circuit. The invention presented herein is not inherently related to a particular computer system or other apparatus. The required structure for a variety of these systems will appear from the description given.

While this invention has been described in relation to certain embodiments, it will be understood by those skilled in the art that other embodiments according to the generic principles disclosed herein, modifications to the disclosed embodiments and changes in the details of construction, arrangement of parts, compositions, processes, structures and materials selection all may be made without departing from the spirit and scope of the invention. Changes, including equivalent structures, acts, materials, etc., may be made, within the purview of the appended claims, without departing from the scope and spirit of the invention in its aspects. Thus, it should be understood that the above described embodiments have been provided by way of example rather than as a limitation of the invention and that the specification and drawing(s) are, accordingly, to be regarded in an illustrative rather than a restrictive sense. As such, the invention is not intended to be limited to the embodiments shown above but rather is to be accorded the widest scope consistent with the principles and novel features disclosed in any fashion herein.

I claim:

1. A wagering system comprising:

a race providing system facilitating wagering on race events at race event tracks and providing information regarding the race events; and at least one wagering terminal in communication with the race providing system, the at least one wagering terminal including a race event selector to select next race events for wagering, the race event selector being configured to determine and make available for wagering future race events in a future time order at multiple race event tracks for which the race providing system has supplied race event information, a display to present information regarding the selected race events, a user interface to place a wager on an elected race event of the selected race events displayed, and a wagering value mechanism to provide a wager amount for the wager on the elected race event.

2. The wagering system of claim 1, wherein at least one of the race providing system and the at least one wagering terminal includes a quick pick race contestant(s) selector receiving handicapping information and odds information from the race providing system to select one or more race contestants of an elected race event for the wager in accordance with the received handicapping information and track odds information.

3. The wagering system of claim 2, wherein the one or more race contestants of an elected race event are selected by:

determining a quick pick value for each race contestant based upon a weighted value of the handicapping information and the track odds information associated with each race contestant; and analyzing the quick pick value for each race contestant to determine a set of race contestants for a specific wager type for the elected race event.

4. The wagering system of claim 3, wherein the handicapping information associated with each race contestant includes:

race contestant's trainer statistics;

race contestant's jockey statistics;

the track condition of the race event; and the times between race events for the race contestant.

5. The wagering system of claim 3, wherein the odds information associated with each race contestant includes a difference between the "morning line" track odds and current track odds information for the race contestant.

6. The wagering system of claim 1, wherein the at least one wagering terminal is configured for providing the wager in only a single wager type.

7. The wagering system of claim 1, wherein the at least one wagering terminal is configured to facilitate placement of the wager in accordance with one of a plurality of user-selectable wager types.

8. The wagering system of claim 1, wherein the wagering value mechanism includes a card receiver for receiving a card having information pertaining to a user account, and an account processor connected to the card receiver for debiting the user account with the wager amount.

9. A wagering terminal in communication with a race providing system that facilitates wagering on race events and provides information regarding the race events at race event tracks, comprising:

a race event selector to select next race events for wagering, the race event selector being configured to determine and make available for wagering, multiple future race events that are selected as selected race events;

a display to present information regarding the selected race events;

a user interface to place a wager on to selected race events displayed; and a wagering value mechanism to provide a wager amount for the wager on the selected race event.

10. The wagering terminal of claim 9, further comprising a quick pick race contestant(s) selector receiving handicapping information and track odds information from the race providing system to select one or more race contestants of a selected race event for the wager in accordance with the received handicapping information and track odds information.

11. The wagering terminal of claim 9, further comprising a wagering processor to receive one or more race contestants of selected race events for the wager selected in accordance with handicapping and track odds information.

12. The wagering terminal of claim 11, wherein the one or more race contestants of a selected race event are selected by:

determining a quick pick value for each race contestant based upon a weighted value of the handicapping information and the track odds information associated with each race contestant; and analyzing the quick pick value for each race contestant to determine a set of race contestants for a specific wager type for the elected race event.

13. The wagering terminal of claim 12, wherein the handicapping information associated with each race contestant includes:

race contestant's trainer statistics;

race contestant's jockey statistics;

the track condition of the race event; and the times between race events for the race contestant.

14. The wagering terminal of claim 12, wherein the track odds information associated with each race contestant includes a difference between the "morning line" track odds and current track odds information for the race contestant.

15. The wagering terminal of claim 9, wherein the wagering terminal is configured for providing the wager in only a single wager type.

16. The wagering terminal of claim 9, wherein the wagering terminal is configured to facilitate placement of the wager in accordance with one of a plurality of user-selectable wager types.

17. The wagering terminal of claim 9, wherein the wagering value mechanism includes a card receiver for receiving a card having information pertaining to a user account, and an account processor connected to the card receiver for debiting the user account with the wager amount.

18. The wagering terminal of claim 9, wherein the user interface includes:

icons corresponding to race contestants in a race event; and at least one of a button or icon by which a user scrolls through next and other future race events by starting time, the activation of the at least one of a button or icon to scroll causing the user interface to present new icons corresponding to the race contestants of the scrolled to next and other future race events.

19. The wagering terminal of claim 18, wherein the user interface further includes:

at least one of a button or icon by which a user scrolls through next race events at different race event tracks, the activation of the at least one of a button or icon to scroll causing the user interface to present new icons corresponding to the race contestants of the next race event by start time at the scrolled to race event tracks.

20. The wagering terminal of claim 18, wherein the icons corresponding to race contestants are shaped in the form of a horse head.

21. The wagering terminal of claim 18, wherein at least some of the icons corresponding to the race contestants are colored differently to indicate odds information associated with the race contestant corresponding to the icon.

22. A wagering terminal receiving information regarding race events, comprising:

a display to present information regarding selected next race events for wagering, the selected race events being selected by a race event selector being configured to determine and make available for wagering, multiple future race events, from among a group of future race events;

a user interface to place a wager on an elected race event of the selected race events displayed;

a wagering value mechanism to provide a wager amount for the wager on the elected race event; and a wagering processor to determine one or more race contestants of an elected race event for the wager selected in accordance with handicapping information and track odds information.

23. The wagering terminal of claim 22, wherein the one or more race contestants of an elected race event are selected by:

determining a quick pick value for each race contestant based upon a weighted value of the handicapping information and the track odds information associated with each race contestant; and analyzing the quick pick value for each race contestant to determine a set of race contestants for a specific wager type for the elected race event.

24. The wagering terminal of claim 23, wherein the handicapping information associated with each race contestant includes:

race contestant's trainer statistics;

race contestant's jockey statistics;

the track condition of the race event; and the times between race events for the race contestant.

25. The wagering terminal of claim 23, wherein the track odds information associated with each race contestant includes a difference between the "morning line" track odds and current track odds information for the race contestant.

26. The wagering terminal of claim 22, wherein the wagering terminal is configured for providing the wager in only a single wager type.

27. The wagering terminal of claim 22, wherein the wagering terminal is configured for facilitating placement of the wager in accordance with one of a plurality of user-selectable wager types.

28. The wagering terminal of claim 22, wherein the user interface includes:

icons corresponding to race contestants in a race event; and at least one of a button or icon by which a user scrolls through next and other future race events by starting time, the activation of the at least one of a button or icon to scroll causing the user interface to present new icons corresponding to the race contestants of the scrolled to next and other future race events.

29. The wagering terminal of claim 28, wherein the user interface further includes:

at least one of a button or icon by which a user scrolls though next race events at different race event tracks, the activation of the at least one of a button or icon to scroll causing the user interface to present new icons corresponding to the race contestants of the next race event by start time at the scrolled to race event tracks.

30. The wagering terminal of claim 28, wherein the icons corresponding to race contestants are shaped in the form of a horse head.

31. The wagering terminal of claim 28, wherein at least some of the icons corresponding to the race contestants are colored differently to indicate odds information associated with the race contestant corresponding to the icon.

32. A wagering method, comprising:

receiving information regarding race events from a race providing system automatically providing multiple future race events at race event tracks on which wagers may be placed;

selecting race events from said multiple race events for wagering on which future race events wagering will be performed;

displaying information regarding the selected race events in a wagering terminal;

receiving user instructions through a user interface of the wagering terminal for placing a wager on an elected race event of the selected race events displayed; and receiving a wager amount for the wager on the elected race event further comprising:

receiving handicapping information and track odds information from the race providing system; and a program selecting one or more race contestants of an elected race event for the wager in accordance with the received handicapping information and track odds information.

33. A computer comprising a program product including computer program code to cause a processor to perform a wagering method, the wagering method comprising:

the program determining and making available for wagering, future race events in a future time order at multiple race event tracks for which the program has enabled provision of race event information receiving the race event information regarding race events from a race providing system;

selecting next race events for wagering;

displaying information regarding the selected race events in a wagering terminal;

receiving user instructions through a user interface of the wagering terminal for placing a wager on an elected race event of the selected race events displayed; and receiving a wager amount for the wager on the elected race event.

34. The computer program product of claim 33, the wagering method further comprising:

receiving handicapping information and track odds information from the race providing system; and selecting one or more race contestants of an elected race event for the wager in accordance with the received handicapping information and track odds information.

35. The computer program product of claim 33, the wagering method further comprising receiving one or more race contestants of an elected race events for the wager selected in accordance with handicapping and track odds information.

36. The computer program product of claim 34, wherein the one or more race contestants of an elected race event are selected by:

determining a quick pick value for each race contestant based upon a weighted value of the handicapping information and track odds information associated with each race contestant; and analyzing the quick pick value for each race contestant to determine a set of race contestants for a specific wager type for the elected race event.

37. The computer program product of claim 36, wherein the handicapping information associated with each race contestant includes:

race contestant's trainer statistics;

race contestant's jockey statistics;

the track condition of the race event; and the times between race events for the race contestant.

38. The computer program product of claim 36, wherein the track odds information associated with each race contestant includes a difference between the "morning line" track odds and current track odds information for the race contestant.

39. The computer program product of claim 33, wherein the computer program product is configured for providing the wager in only a single wager type.

40. The computer program product of claim 33, wherein the computer program product is configured for providing the wager in accordance with one of a plurality of user-selectable wager types.

41. The computer program product of claim 33, wherein receiving a wager amount for the wager includes accessing a user account electronically and debiting the user account with the wager amount.

42. The computer program product of claim 33, wherein displaying information regarding the selected race events in a wagering terminal includes:

displaying icons corresponding to race contestants in a race event; and providing at least one of a button or icon by which a user scrolls through next and other future race events by staffing time, the activation of the at least one of a button or icon to scroll causing the display of new icons corresponding to the race contestants of the scrolled to next and other future race events on which wagers may be placed at that time.

43. The computer program product of claim 42, wherein displaying information regarding the selected race events in a wagering terminal further includes:

providing at least one of a button or icon by which a user scrolls through next race events at different race event tracks, the activation of the at least one of a button or icon to scroll causing the display of new icons corresponding to the race contestants of the next race event by start time at the scrolled to race event tracks.

44. The computer program product of claim 42, wherein the icons corresponding to race contestants are shaped in the form of a horse head.

45. The computer program product of claim 42, wherein at least some of the icons corresponding to the race contestants are colored differently to indicate odds information associated with the race contestant corresponding to the icon.

* * * * *

UNITED STATES PATENT AND TRADEMARK OFFICE

CERTIFICATE OF CORRECTION

PATENT NO. : 6,722,980 B2
DATED : April 20, 2004
INVENTOR(S) : Andrew M. Stronach It is certified that error appears in the above-identified patent and that said Letters Patent is hereby corrected as shown below:

Title page,
Insert Item -- [73] Assignee: ASIP Holdings, Inc., Aurora, Ontairo (CA) --.

Signed and Sealed this

Sixth Day of September, 2005

JON W. DUDAS
*Director of the United States Patent and Trademark Office*